United States Patent [19]

Johnson, Jr.

[11] Patent Number: 4,474,251

[45] Date of Patent: Oct. 2, 1984

[54] ENHANCING LIQUID JET EROSION

[75] Inventor: Virgil E. Johnson, Jr., Gaithersburg, Md.

[73] Assignee: Hydronautics, Incorporated, Laurel, Md.

[21] Appl. No.: 324,251

[22] Filed: Nov. 25, 1981

Related U.S. Application Data

[63] Continuation-in-part of Ser. No. 287,870, Jul. 29, 1981, abandoned, which is a continuation-in-part of Ser. No. 215,829, Dec. 12, 1980, Pat. No. 4,389,071.

[51] Int. Cl.[3] ..... E21B 7/18

[52] U.S. Cl. ..... 175/67; 239/101; 239/102; 299/17

[58] Field of Search ..... 299/14, 17; 239/101, 239/102; 134/1; 175/67

[56] References Cited

U.S. PATENT DOCUMENTS

| | | | |
|---|---|---|---|
| 3,398,758 | 9/1965 | Unfried | 137/81.5 |
| 3,405,770 | 10/1968 | Galle et al. | 175/56 |
| 3,528,704 | 7/1968 | Johnson, Jr. | 299/14 |
| 3,545,552 | 12/1968 | Angona | 175/65 |
| 3,713,699 | 1/1973 | Johnson, Jr. | 299/14 |
| 3,807,632 | 4/1974 | Johnson, Jr. | 239/104 |
| 3,840,078 | 10/1974 | Allgood et al. | 175/15 |
| 3,881,559 | 5/1975 | Allgood et al. | 175/67 |
| 3,897,836 | 8/1975 | Hall et al. | 239/101 X |
| 3,983,740 | 10/1976 | Danel | 73/12 |
| 4,041,984 | 8/1977 | Morel | 137/842 |
| 4,071,097 | 1/1978 | Fulop et al. | 175/56 |
| 4,185,706 | 1/1980 | Baker et al. | 175/340 |
| 4,262,757 | 4/1981 | Johnson, Jr. et al. | 175/67 |
| 4,389,071 | 6/1983 | Johnson et al. | 299/14 |

OTHER PUBLICATIONS

"Orderly Structure in Jet Turbulence," Journal of Fluid Mechanics, S. G. Crow and F. H. Champagne, vol. 48, Part 3, Aug. 1971.

"Experimental Study of a Jet Driven Helmholtz Oscillator," *ASME Journal of Fluids Engineering*, T. Morel, vol. 101, pp. 383–390, Sep. 1979.

"Cavijet Augmented Deep-Hole Drilling Bits", Paper No. 77-Pet-54, a publication of American Society of Mechanical Engineers (ASME), A. F. Conn and R. P. Radtke.

*Primary Examiner*—Ernest R. Purser

*Attorney, Agent, or Firm*—Finnegan, Henderson, Farabow, Garrett & Dunner

[57] ABSTRACT

Process and apparatus for enhancing the erosive intensity of a high velocity liquid jet when the jet is impacted against a surface for cutting, cleaning, drilling or otherwise acting on the surface. A preferred method comprises the steps of forming a high velocity liquid jet, oscillating the velocity of the jet at a preferred Strouhal number, and impinging the pulsed jet against a solid surface to be eroded. Typically the liquid jet is pulsed by oscillating the velocity of the jet mechanically or by hydrodynamic and acoustic interactions. The invention may be applied to enhance cavitation erosion in a cavitating liquid jet, or to modulate the velocity of a liquid jet exiting in a gas, causing it to form into discrete slugs, thereby producing an intermittent percussive effect.

31 Claims, 37 Drawing Figures

Fig. 3a
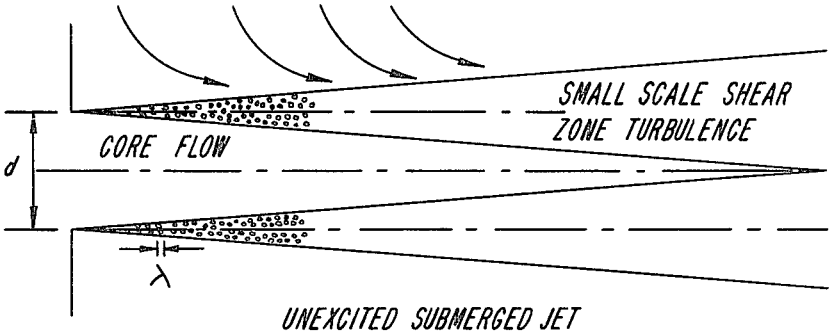
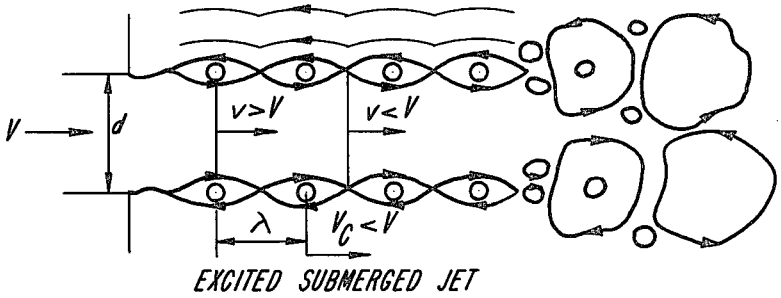
Fig. 3b
Fig. 4a
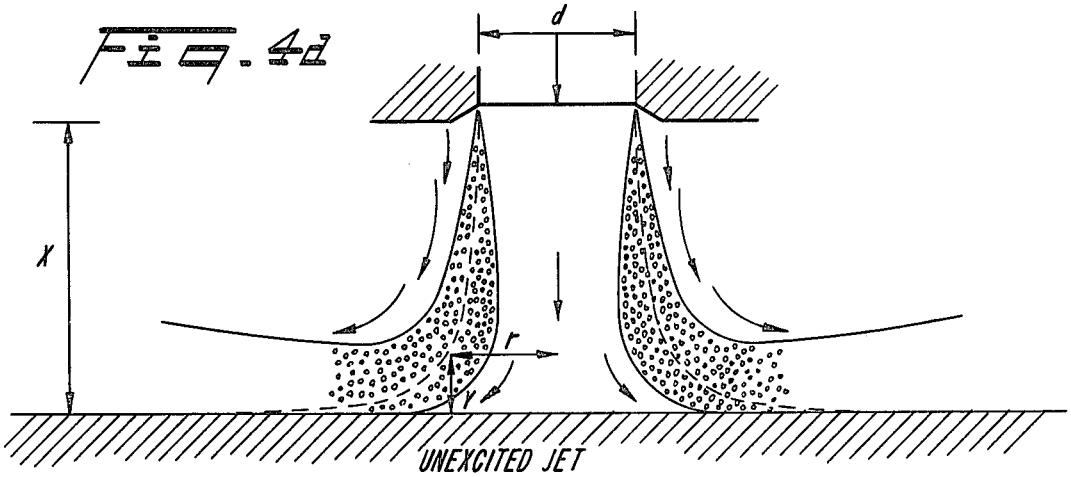
Fig. 4b
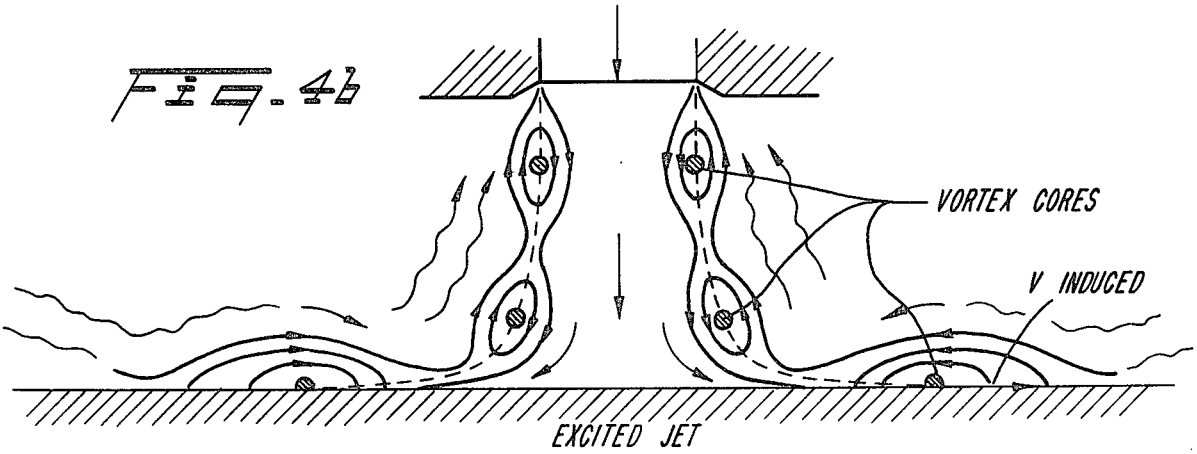

FIG. 5
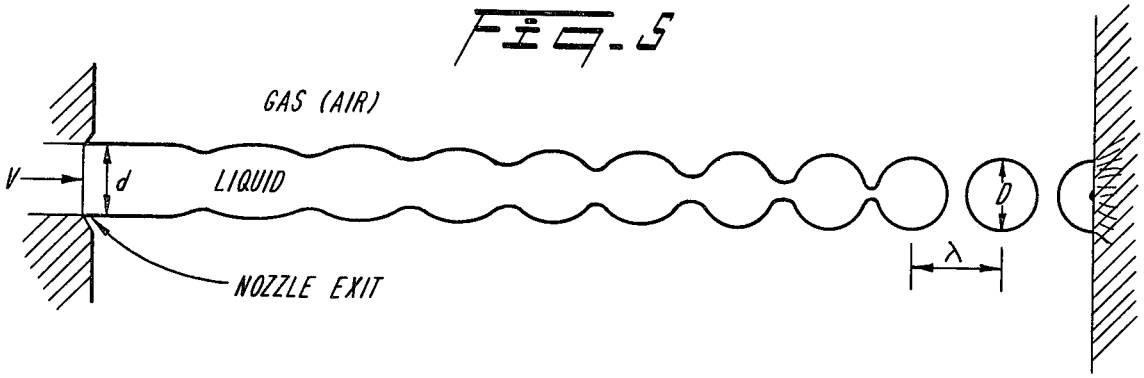
FIG. 6a
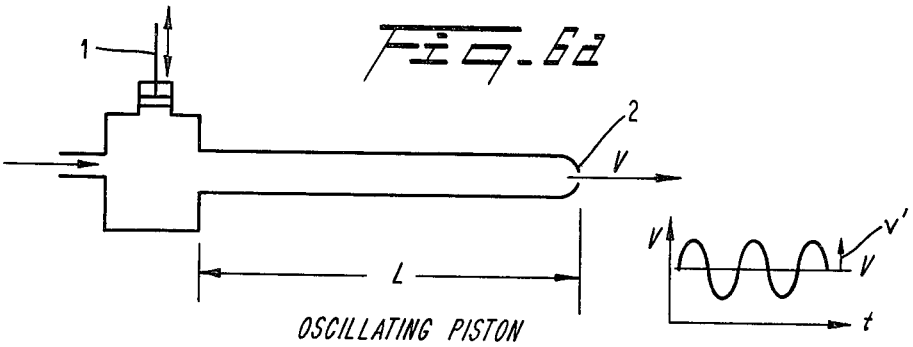
OSCILLATING PISTON
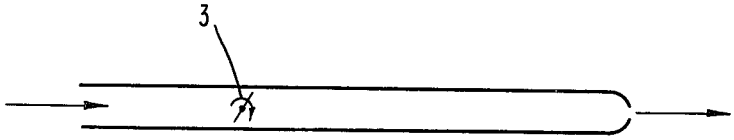
FIG. 6b
FIG. 6c
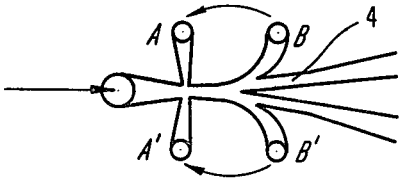
FLUID OSCILLATOR VALVE
FIG. 6d
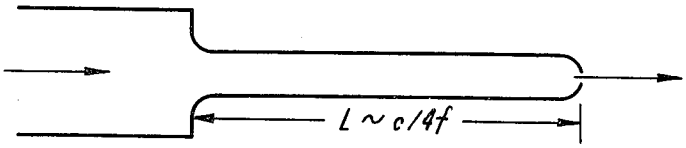
ORGAN PIPE ACOUSTIC OSCILLATOR
FIG. 6e
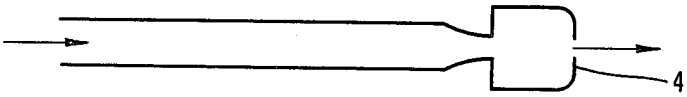
HELMHOLTZ ACOUSTIC OSCILLATOR

NO EXCITATION

EXCITATION (f= 5,156 Hz)

EXCITATION (f=10,310 Hz)

ENHANCING LIQUID JET EROSION

CROSS-REFERENCE TO RELATED APPLICATIONS

This application is a continuation-in-part of U.S. patent application Ser. No. 287,870, filed July 29, 1981 and now abandoned, which is a continuation-in-part of U.S. application Ser. No. 215,829, filed Dec. 12, 1980, now U.S. Pat. No. 4,389,071.

BACKGROUND OF THE INVENTION

The invention relates to a process and apparatus for pulsing, i.e., oscillating, a high velocity liquid jet at particular frequencies so as to enhance the erosive intensity of the jet when the jet is impacted against a surface to be eroded. Eroding conditions include cleaning, cutting, drilling or otherwise acting on the surface. The method may be particularly applied to enhance cavitation in a cavitating liquid jet such as described in U.S. Pat. Nos. 3,528,704, 3,713,699 and 3,807,632 and U.S. patent application Ser. No. 931,244. It may also be used to modulate the velocity (at particularly preferred frequencies) of a simple high velocity liquid jet exiting in a gas in such a way as to cause the jet to become a series of water slugs or drops which upon impact produce water hammer blows to the surface to be eroded.

In U.S. Pat. Nos. 3,713,699 and 3,807,632, cavitation, that is, the formation of vapor cavities or bubbles in a high velocity liquid jet in the shear zone between a high velocity jet and a relatively low velocity fluid, which surrounds the jet when the jet is either naturally or artificially submerged, is described as an important source of the vapor cavities in the jet. Furthermore, the patents disclose the concept of pulsing the jet.

Experiments have been reported using air jets discharging into a gaseous atmosphere. See, S. C. Crow and F. H. Champagne, "Orderly Structure in Jet Turbulence", *Journal of Fluid Mechanics,* Vol. 48, Part 3, August 1971. These experiments related to understanding the production of jet aircraft noise, and revealed that when the jet exit velocity, V, is oscillated about its mean value with an amplitude equal to only a few percent of the mean value, the structure of the jet altered dramatically when the frequency of oscillation (f) was in the range of 0.2 to 1.2 times the ratio of the jet velocity, V, to the jet diameter, D. That is, the jet structure change occurred for a range of Strouhal numbers, S, defined as (fD/V), between 0.2 and 1.2. The most dramatic change in the jet structure occurred for S=0.3 and 0.6. The shear zone surrounding the air jet apparently changes from a zone of largely uncorrelated fine scale eddies to a series of discrete vortices convecting down the periphery of the jet at a speed approximately equal to 0.7 of the jet exit speed. These vortices therefore have a spacing of approximately the jet diameter and appear to an observer stationary with respect to the nozzle exit as waves having a wavelength of the same order as the vortex spacing. This well-defined structure of the air jet is observed to break up after several jet diameters into a turbulent flow.

U.S. Pat. No. 3,398,758 discloses an air jet driven pure fluid oscillator as a means of providing a pulsating jet as a carrier wave for a communication device.

In "Experimental Study of a Jet Driven Helmholtz Oscillator," *ASME Journal of Fluids Engineering,* Vol. 101, September 1979, and U.S. Pat. No. 4,041,984, T. Morel presents extensive information on air jet driven Helmholtz oscillators and indicates that he was not able to achieve satisfactory operation for jet speed to sound speed ratios (Mach number) greater than 0.1.

U.S. Pat. No. 4,071,097 describes an underwater supersonic drilling device for establishing ultrasonic waves tuned to the natural frequency of rock strata. This device suffers from the oscillators described by Mr. Morel or in U.S. Pat. No. 3,398,758, in that the resonance chamber is fed by an orifice which has a disturbing element placed in the orifice so as to partially obstruct the orifice.

U.S. Pat. No. 3,983,740 describes a method and apparatus for producing a fast succession of identical and well-defined liquid drops which are impacted against a solid boundary in order to erode it. The ultrasonic excitation of the liquid jet is accomplished with a magnetostrictive ultrasonic generator having a wavelength approximately equal to the jet diameter.

U.S. Pat. No. 3,405,770 discloses complex devices for oscillating the ambient pressure at the bottom of deep holes drilled for oil and/or gas production. These devices oscillate the ambient pressure at a low frequency (i.e., less than 100 Hz). The purpose of such oscillations is to relieve the overbalance in pressure at the hole bottom, so that chips may be removed, thus increasing the drilling rate.

SUMMARY OF THE INVENTION

The present invention provides a method of eroding a solid surface with a high velocity liquid jet, comprising the steps of forming a high velocity liquid jet, oscillating the velocity of the jet at a Strouhal number within the range of from about 0.2 to about 1.2, and impinging the pulsed jet against the solid surface. Typically the liquid jet is pulsed by oscillating the velocity of the jet mechanically, or by hydrodynamic and acoustic interactions.

Objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

As embodied herein, the invention further provides a method as described above, wherein the liquid jet is pulsed by situating it within a chamber submerged in a liquid, said chamber containing a further liquid jet which is pulsed at a Strouhal number within the range of from about 0.2 to about 1.2, whereby the oscillation of the further liquid jet induces oscillation of the liquid jet.

In a further embodiment the liquid jet is formed by directing a liquid through an orifice, and the jet is pulsed by oscillating the pressure of the liquid prior to directing it through the orifice.

In another embodiment the liquid is directed through a first orifice and the jet is formed by directing the liquid through a second orifice, and the jet is pulsed by oscillating the pressure of the liquid after it exits the first orifice through hydrodynamic and acoustic interactions. Typically a Helmholtz chamber is formed between the first and second orifices, wherein the pressure of the liquid is oscillated within the Helmholtz oscillator, and a portion of the energy of the high velocity liquid is utilized to pulse the liquid.

As embodied herein, the invention further provides a method as broadly described above, wherein the pulsed, high velocity liquid jet is surrounded by a gas and forms into discrete, spaced apart slugs, thereby producing an intermittent percussive effect. Typically, the liquid comprises water and the gas comprises air, and the velocity of the jet is oscillated at a Strouhal number within the range of from about 0.66 to about 0.85, and the distance between the solid surface and the orifice from which the jet exits is determined by the following equation:

$$X=(D/2S)\cdot(V/v')$$

where X is the distance, D is the orifice diameter, S is the Strouhal number, V is the mean jet velocity and v' is the oscillation amplitude about the mean velocity.

As embodied herein, the invention further provides a method as broadly described above, wherein the pulsed high velocity liquid jet is surrounded by a liquid and forms into discrete, spaced apart vortices, and wherein vapor cavities of the liquid are formed in the vortices and the vortices spread over the solid surface at a distance from the orifice where said vapor cavities collapse, thereby producing cavitation erosion. Typically, the velocity of the pulsed liquid jet is at least about Mach 0.1, and the velocity of the jet is oscillated at a Strouhal number within the range of from about 0.3 to about 0.45, or from about 0.6 to about 0.9, and the distance between the solid surface and the orifice from which the jet exits is no greater than about 6 times the diameter of the jet, for cavitation numbers greater than about 0.2.

As embodied herein, the invention further provides a method as broadly described above, wherein the pulsed, high velocity liquid jet forms into discrete, spaced apart vortices, and wherein vapor cavities of the liquid are formed in the vortices and the vortices spread over the solid surface at a distance from the orifice where said vapor cavities collapse, thereby producing cavitation erosion, the formation of vapor cavities being assisted by a center body located in the outlet of the jet-forming nozzle to form an annular orifice for the nozzle.

Broadly, the invention further comprises apparatus for producing a pulsed liquid jet for eroding a solid surface, comprising means for forming a high velocity liquid jet, and means for oscillating the velocity of the jet at a Strouhal number within the range of from about 0.2 to about 1.2. Typically, the means for oscillating the velocity of the jet comprises a mechanical oscillator, and the mechanical oscillator typically comprises an oscillating piston or an oscillating mechanical valve.

Alternately, the means for oscillating the velocity of the jet may comprise a hydro-acoustic oscillator. Typically, the oscillator comprises an organ-pipe oscillator or a Helmholtz oscillator.

Alternately, the means for oscillating the velocity of the jet comprises a fluid oscillator valve.

As embodied herein, the invention further provides apparatus for producing a pulsed liquid jet for eroding a solid surface, comprising a liquid jet nozzle for discharging a liquid jet, said liquid jet nozzle having a housing for receiving a liquid, said housing having an interior chamber contracting to a narrower outlet orifice, and a Helmholtz oscillator chamber situated in tandem with the liquid jet nozzle for oscillating the liquid jet at a Strouhal number within the range of from about 0.2 to about 1.2, said outlet orifice of the cavitating liquid jet nozzle comprising the inlet to the Helmholtz oscillator chamber and said Helmholtz oscillator chamber having a discharge orifice for discharging the pulsed liquid jet. Typically, a portion of the volume of the Helmholtz oscillator chamber is located in an annular space surrounding said outlet orifice.

As further embodied herein, the invention comprises apparatus for producing a pulsed liquid jet for eroding a solid surface, comprising a liquid jet nozzle for discharging a liquid jet, said liquid jet nozzle having a housing for receiving a liquid, said housing have an interior chamber contracting to a narrower outlet orifice, a Helmholtz oscillator chamber situated in tandem with the liquid jet nozzle for oscillating the liquid jet at a Strouhal number within the range of from about 0.2 to 1.2, said outlet orifice of the liquid jet nozzle comprising the inlet to the Helmholtz oscillator chamber and said Helmholtz oscillator chamber having a discharge orifice, and a diffusion chamber situated in tandem with the Helmholtz oscillator chamber, said discharge orifice of the Helmholtz oscillator chamber comprising the inlet to the diffuser chamber, said diffusion chamber contracting to a narrower jet-forming orifice and smoothing the inflow to the jet-forming orifice.

Broadly, the invention further comprises apparatus for producing a pulsed liquid jet for eroding a solid surface, comprising hydro-acoustic nozzle means for oscillating the velocity of a first liquid jet, said first liquid jet being discharged within a chamber, at least one cavitating liquid jet nozzle having a housing for receiving a liquid, said housing having an interior chamber contracting to a narrower discharge orifice for discharging a second liquid jet within said chamber such that the velocity of said second liquid jet is pulsed by the action of the pulsed first liquid jet, thereby increasing its erosive intensity. Typically, the apparatus may further comprise a roller bit for drilling a hole in the solid surface, at least two extension arms for supplying drilling fluid to the hole, and at least two cavitating liquid jets situated at the extremities of said extension arms, and wherein said chamber comprises the hole filled with drilling fluid.

BRIEF DESCRIPTION OF THE DRAWINGS

FIGS. 3*a* and 3*b* show a comparison of flow patterns for excited and unexcited submerged jets;

FIG. 4*a* shows an unexcited submerged liquid cavitating jet impinging on a solid boundary, and FIG. 4*b* shows an excited submerged liquid cavitating jet impinging on a solid boundary;

FIG. 5 shows a percussive liquid jet exiting into a gas and forming a series of slugs or drops which impinge on a solid boundary;

FIG. 6 shows five alternate general concepts for pulsing fluid jets in accordance with the present invention;

FIG. 21 illustrates the formation of discrete ring vortices;

DESCRIPTION OF THE PREFERRED EMBODIMENTS

Reference will now be made in detail to the presently preferred embodiments of the invention, examples of which are illustrated in the accompanying drawings.

I have found that if a cavitating liquid jet, as opposed to an air jet, is excited so as to structure itself into discrete vortices, such a liquid jet will cavitate more violently and thus cause greater erosion to a boundary placed near the jet exit at an optimum stand-off distance. I have determined that a liquid jet excited at the proper Strouhal number will cavitate much more readily than would be predicted from the simple increase in velocity during a peak velocity amplitude accompanying an excitation.

For ease in understanding the invention, the parameters referred to as the cavitation number, $\sigma$, and the incipient cavitation number, $\sigma_i$, will be explained briefly.

Since the invention is concerned with high velocity liquid jets, the characteristic pressure and velocity selected for the definitions are:

$P_o$=the pressure in the supply pipe for a high speed jet nozzle.

$P_a$=the pressure to which the jet is exhausted; that is, the ambient pressure surrounding the jet.

$P_v$=the vapor pressure of the liquid at the liquid temperature.

$\rho$=the mass density of the liquid.

V=the mean jet speed.

The cavitation number $\sigma$ may then be defined as:

$$\sigma = \frac{P_a - P_v}{\frac{1}{2}\rho V^2} \tag{1}$$

The value, $\frac{1}{2}\rho V^2$, will be equal to a constant times $(P_o-P_a)$, or denoting $(P_o-P_a)$ as $\Delta P$, a constant times $\Delta P$. This constant depends on the nozzle configuration, and in most cases may be assumed to be equal to one. Furthermore, for high pressure jets, $P_v$ is much less than $P_o$ and in many cases the cavitation number for jets may be approximated by $\sigma=P_a/\Delta P$.

The particular value of $\sigma$ when cavitation first starts, or is incipient, is denoted as $\sigma_i$. That is, $$\sigma_i = \left(\frac{P_o - P_v}{\frac{1}{2}\rho V^2}\right) \tag{2}$$

For the purpose of this explanation, it may be assumed that the necessary nuclei for cavitation to occur, when local pressures reach the vapor pressure, are present. Cavitation will be incipient when the minimum pressure at the location of inception first reaches the vapor pressure. Thus $$\sigma_i = \left(\frac{P_o - P_{min}}{\frac{1}{2}\rho V^2}\right) \tag{3}$$

where $P_{min}$ is the minimum pressure at the location of inception.

Figure 1:
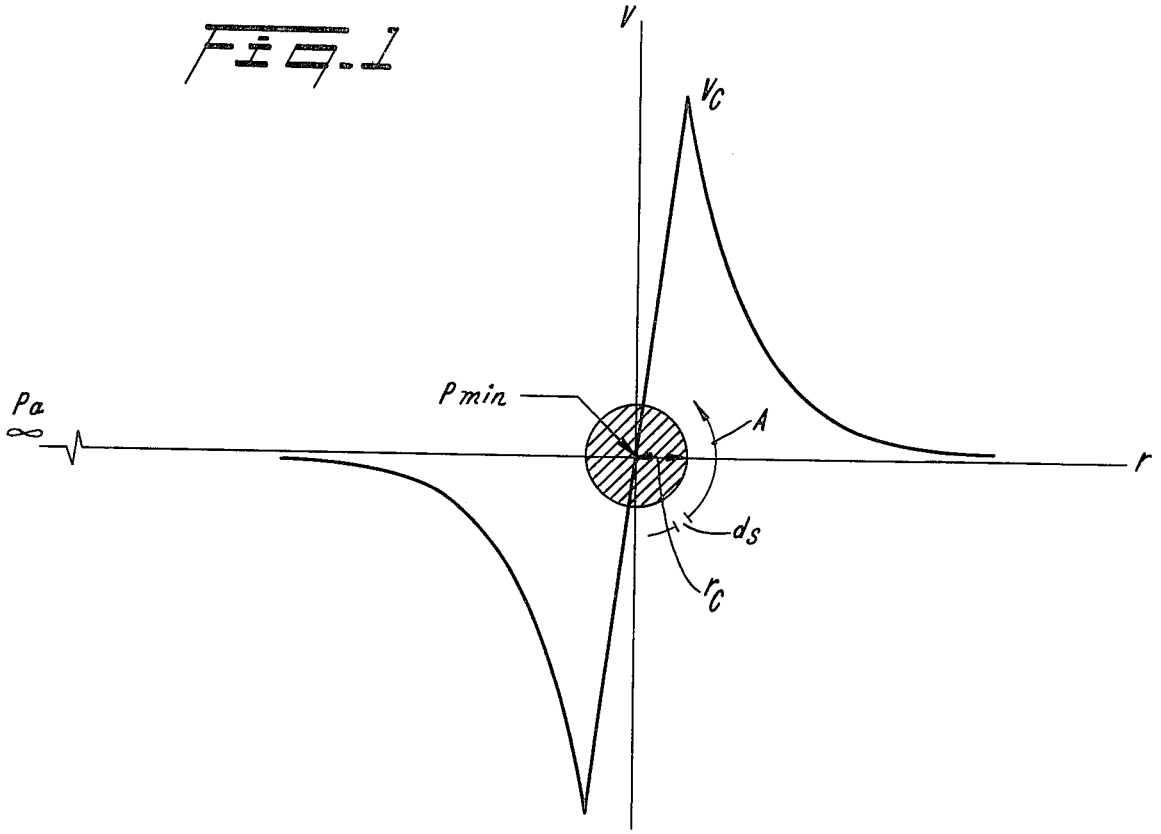
FIG. 1 shows the velocity distribution in a Rankine line vortex.

FIG. 1 shows the velocity distribution in a line vortex rotating in the direction shown by arrow A having a forced (rotational) core radius denoted as $r_c$ and a velocity at $r_c$ equal to $V_c$. Such a vortex is called a Rankine vortex and is a reasonable approximation of vortices which exist in real fluids having viscosity. For such a single line vortex, the value of the pressure drop from the ambient pressure, $P_a$, to the minimum pressure $P_{min}$ (as shown in FIG. 1) which exists at the center of the core is $$\frac{P_a - P_{min}}{\frac{1}{2}\rho V^2} = \frac{\Gamma^2}{2\pi^2 V^2 r_c^2} = \sigma_i \text{ (Vortex center)} \quad (4)$$

where $\Gamma$ is the circulation around the vortex. That is, $$\Gamma = \oint v \cdot ds \quad (5)$$

Figure 2:
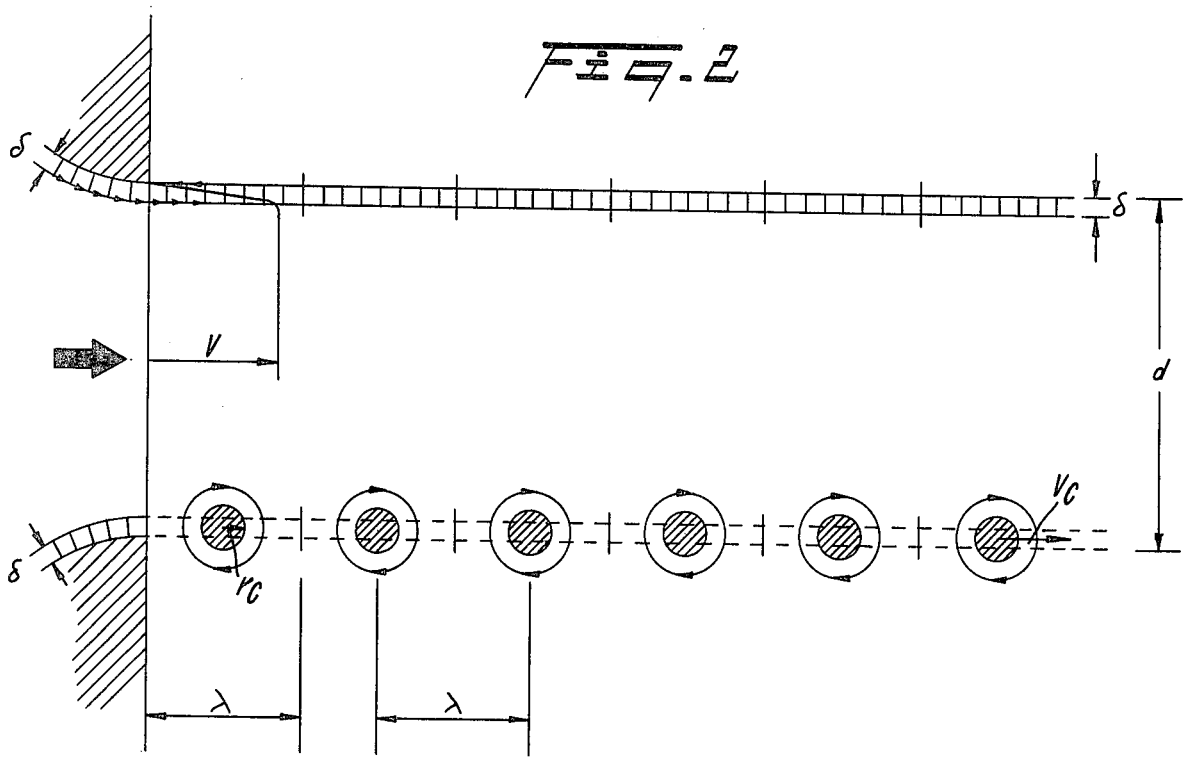
FIG. 2 shows the core size of ieal ring vortices formed in the shear zone of a submerged jet.

FIG. 2 illustrates schematically how the core size of ideal ring vortices formed in the shear zone of a submerged jet is assumed to be established. Flow leaves the nozzle exit, of diameter D, with a uniform velocity, V, over the nozzle exit plane except for the boundary layer region, which is of characteristic thickness, $\delta$. The ideal shear zone, assuming no mixing with an outer fluid, is shown in the upper portion of the nozzle. In a real flow, exterior fluid is entrained and Rankine vortices form, with the rotational boundary fluid as the core. The lower portion shows how the core of distinct vortices, having a spacing denoted as $\lambda$, have a core made up of fluid that has an area equal to $\lambda\delta$. If the core of these distinct vortices is assumed to be circular then $$r_c^2 = \lambda\delta/\pi \quad (6)$$

The circulation of each vortex is obviously $\lambda V$. Thus, from equation (5)

$$\sigma_i \text{, (Vortex Center)} = \frac{V^2\lambda^2}{V^2 2\pi^2\left(\frac{\lambda\delta}{\pi}\right)} = \frac{\lambda}{2\pi\delta} \quad (7)$$

Since $\sigma_i$ is desired to be as high as possible in order to cause increased cavitation and erosion, it is preferable for a given nozzle liquid and speed ($\delta$ being fixed), to have $\lambda$ as large as possible. As shown in FIG. 3, for unexcited jets, the shear zone has many small vortices ($\lambda$ is small and of order $\delta$,) whereas I have found that, for an excited jet, $\lambda$ is of the order of the jet diameter, d.

The preceding analysis is not exact because of the various simplifying assumptions made, (for example, the detailed pressure distribution in a ring vortex system is more complex) but the important result shown is that, qualitatively, $(\sigma_i)$ excited is much greater than $(\sigma_i)$ unexcited.

It is important to note the above-described increase in cavitation inception for a liquid jet excited at a preferred Strouhal number is entirely different from the increase that might obviously be assumed based on a quasi steady state analysis. That is, $$(\sigma_i) \text{ pulsed} = \sigma_i \text{ steady}\left(1 + \frac{v'}{V}\right)^2 \quad (8)$$

where v' is the magnitude of the excitation amplitude that is, maximum velocity=V+v'. Very small amplitudes of excitation (v'/V=0.02) are required to achieve jet structuring and thus substantial increases in $\sigma_i$ may be achieved for structured jets. Such substantial increases in $\sigma_i$ would not be suggested by equation (8).

The general effect described in the foregoing analysis is independent of the stand-off distance, X, i.e., the distance from the nozzle end to the fixed boundary to be eroded by a cavitating jet. In fact, the analysis neglected the boundary influence. I have determined that significant additional new cavitation effects occur at relatively short stand-off distances, for example X<6d. These effects are illustrated in FIGS. 4*a* and 4*b*. The upper figure, 4*a*, shows an unexcited submerged liquid jet (with small scale random vortices) impinging on a solid boundary only a few diameters (d) away. The lower figure, 4*b*, illustrates a submerged liquid jet excited at a preferred Strouhal number, with discrete vortices impinging on a solid boundary.

The dashed lines in FIGS. 4*a* and 4*b* having coordinates (r,y) represent the jet boundary that would exist if there were no mixing. It is assumed in FIG. 4*b* that the vortex centers lie on this path. For values of $r/d \geqq 1$, this path can be obtained from the continuity equation (assuming the flow in this outer region is entirely radial). The approximate equation for this path is, $$\frac{y}{d} = \frac{1}{8}\frac{d}{r} \text{ or } \frac{r}{d} = \frac{1}{8}\frac{d}{y} \quad (9)$$

Thus, as the vortex rings approach the boundary (d/y increases and thus r/d increases), the ring size increases. It is fundamental in hydrodynamics that such a "stretching" of a vortex will result in a decrease in core size. In fact, if it is assumed that the core fluid in a ring of radius $r_1$ redistributes to fill the same volume when the ring stretches to a new radius $r_2$, the ratio of core sizes will be given by the following equation $$\left(\frac{r_{c,2}}{r_{c,1}}\right)^2 = \frac{r_1}{r_2} \quad (10)$$

Thus, from equation (4)

$$\frac{(\sigma_i)_2}{(\sigma_i)_1} = \frac{r_2}{r_1} \quad (11)$$

Assuming that $(\sigma_i)_1$, represents the value of $\sigma_i$ in a ring near the nozzle exit and thus away from the boundary, with $r_1 = d/2$, the value of $(\sigma_i)_2$ for a ring closer to the boundary, as given by equation (9) becomes $$\frac{(\sigma_i)_2}{(\sigma_i)_1} = \frac{1}{4}\frac{d}{y} \quad (11a)$$

$$\left(\text{For } \frac{r}{d} \geqq 1, \text{ thus } \frac{d}{y} \geqq 8\right)$$

Thus, in the absence of viscous effects (core size growth due to viscosity and circulation decrease caused by wall friction), cavitation should first occur in the vortices as they spread over the boundary rather than at their birth near the nozzle. I have found that these effects tend to cause the actual core minimum pressure to occur somewhere between the exit orifice and $r/d \simeq 2$. The exact location must be determined by experiment. However, this analysis illustrates that the presence of a boundary should further enhance the cavitation in an excited jet with discrete vortices. This effect has been confirmed by experiment.

Possibly a more important influence of a boundary on the cavitation characteristics of an excited jet with discrete vortices is the reduction in pressure on the boundary that should result as a vortex spreads radially over it. This effect is also shown in FIG. 4*b*.

In the absence of viscosity, the velocity field near the vortex of strength Γ in FIG. 4*b* varies inversely with distance from the vortex. The actual induced velocity at the boundary may be approximately determined by placing an image of the vortex within the boundary and is, for a vortex circulation of Vλ, $$V_{induced} = \frac{8 \cdot V\lambda\, r}{\pi\, d\, d} \tag{12}$$

Thus the total instantaneous velocity, $V_t$, on the wall beneath a vortex as it sweeps over the boundary is approximately $$V_t = V + \frac{1}{\pi}\ \frac{V\lambda}{d}\ \frac{d}{y} \tag{13}$$

and the pressure at this point, from Bernouilli's equation, is given by $$\frac{Pd - P\min}{\frac{1}{2}\rho V^2} = \sigma_{i\ boundary} = \left(1 + \frac{1}{\pi}\ \frac{\lambda}{d}\ \frac{d}{y}\right)^2 - 1 \tag{14}$$

Substitution of equation (9) into equation (14) results in $$\sigma_{i\ boundary} = \left(1 + \frac{8}{\pi}\ \frac{\lambda}{d}\ \frac{r}{d}\right)^2 - 1 \text{ for } \frac{r}{d} > 1 \tag{15}$$

Equation (15) reveals that very high values of $\sigma_{i\ boundary}$ will obtain even for r/d=1; that is, $\sigma_{i\ boundary} \cong 12$ (for $\lambda/d \cong 1$).

As will be discussed below, the value given in equation (15) is also the negative of the pressure coefficient, K, on the boundary, where $K=(P_b-P_a)/\frac{1}{2}\rho V^2 = -Y_{i\ boundary}$. This low pressure induced on the boundary will be significant in cleaning the bottom of deep holes (e.g., for oil and/or gas wells) drilled with mechanical bits which incorporate jets structured into discrete vortices, as described herein.

Viscous effects will modify the result given in equation (15). Obviously, friction and vortex breakdown will begin to have large influence even for r/d<1. But equation (15) indicates that cavitation inception for short stand off distances where the discrete vortices in an excited jet have not yet broken down, will have high values on the wall beneath the vortex as it spreads. These cavities which occur on the wall, rather than in the vortex cores, should be most damaging to the boundary material because they are immediately collapsed by the higher than ambient pressures which are induced by the vortex after it passes and before the following vortex has arrived.

Thus, I have determined that the performance of a cavitating jet can be significantly improved if the jet velocity is oscillated, that is, excited (pulsed), at preferred Strouhal numbers so as to cause the jet to structure into discrete vortices, and that there are at least three reasons for this. I have found that liquid jets will structure into such discrete vortices for the range of excitation Strouhal numbers of from about 0.2 to about 1.2, and that for configurations tested in water using a cavitating jet nozzle constructed in accordance with the teachings of allowed U.S. patent application Ser. No. 931,244, the optimum Strouhal numbers are about 0.45 and about 0.90.

The preferred Strouhal number (based on nozzle diameter, $S=fD_1/V$) for which a jet structures into discrete vortices in an optimum way depends on the nozzle contour. I have found that by properly shaping the nozzle contour, the critical Strouhal number, at which discrete ring vortices are formed can be varied from about 0.3 to 0.8.

It is important to recognize that the enhancement of erosion caused by pulsing (exciting) the jet at a preferred frequency is not the known effect to be expected from pulsing a jet at any frequency, whereby increased erosion during the peak velocity is greater than the loss in erosion during the reduced velocity. Furthermore, this known mechanism requires large amplitudes of oscillation to gain relatively small increases in net erosion for a given power input. The method and process of the present invention require a definite frequency of oscillation (excitation) and the magnitude need only be a few percent of the mean velocity.

In addition to cavitation erosion, which relies on submerged jets, another form of high pressure jet erosion utilizes intermittent or percussive jets, which involve high-pressure liquid jets of diameter, d, discharged into a gas such as the ambient atmosphere. FIG. 5 shows a liquid jet exiting into a gas, with the jet impinging on a solid boundary. If the exit velocity is oscillated, the jet will break into a series of slugs or drops having a final spacing, λ, between drops determined by $$\lambda = V/f \tag{16}$$

where V is the mean jet speed and f is the frequency of oscillation.

If the final drops are assumed to be spherical, their diameter, D, must be such as to contain the volume $\pi\lambda d^2/4$. Thus, $$\left(\frac{D}{d}\right)^3 = \frac{3}{2}\ \frac{V}{fd} \text{ or } \frac{3}{2}\, S_d^{-1} \tag{17}$$

where $S_d$ is the Strouhal number based on jet diameter, d.

These slugs or drops in such percussive jets produce impact or waterhammer pressure (ρcV), where c is the sound speed in the liquid) which is much higher than the pressure generated by a continuous jet ($\frac{1}{2}\rho V^2$).

It is known that such percussive jets tend to be more erosive than continuous jets, and that their intensity of erosion increases with the modulation frequency. I have determined that improved erosion may be obtained if percussive jets are oscillated at a frequency within the range of Strouhal numbers S=about 0.2 to about 1.2 which, by coincidence, is the same range as that required to structure a submerged jet. The mechanisms which lead to this optimum range are entirely different, however.

In percussive jets the impact pressure will be cushioned or relieved if the water from one slug is not given adequate time to escape prior to the arrival of the following slug or drop. This time of of the order of magnitude of the total time (T) of crushing of one slug, and can be approximated by:

$$T \approx D/V \tag{18}$$

The frequency of impact must therefore be smaller than:

$$\left.\begin{aligned} & f \leqq \frac{V}{D} \\ & \text{Thus,} \\ & S_d = \frac{fd}{V} \leqq \frac{d}{D} \end{aligned}\right\} \tag{19}$$

which, by taking equation (17) into account, can be written:

$$S_d \leqq 0.85. \tag{20}$$

Once it is formed, a drop or slug cannot keep it integrity for a long period of time. Ths equilibrium between surface tension forces and aerodynamic drop forces is preserved as long as the Weber number:

$$We = \rho V^2 D / \phi \tag{21}$$

(where $\phi$ is the surface tension) is not bigger than a limiting value ($\approx 50$). This limits the maximum stable drop diameter to a fraction of microns. However, the distance needed for rupture is several times D, so that if the target is close to the region where the drops are first formed rupture can be avoided. In addition, drag forces can be reduced by trying to produce slugs with diameter, D, close to the jet diameter, d. This can be written:

$$\frac{D}{d} = \left(\frac{3}{2S_d}\right)^{\frac{1}{3}} \leqq 1, \text{ or } S_d \geqq 0.66. \tag{22}$$

The optimum region is a narrow one: $0.66 \leqq S_d \leqq 0.85$. Obviously this range is intended for guidance only. The actual optimum range is probably broader and centered around 0.75, say 0.2 to 1.2.

This finding of an optimum Strouhal number for percussive jets is significant, because it means that nozzle systems developed to produce structured ring vortex cavitating jets in submerged or artificially submerged operation should also be near optimum nozzle systems for percussive operation when not submerged or artificially submerged.

There will likely also be an optimum stand-off distance for percussive jets which will be dependent on the Strouhal number and amplitude of the jet excitation, v'. The following analysis gives an approximation to the required relationships.

If $\lambda$ is the wavelength of the modulation frequency, a crest will overtake a trough after a time T:

$$T = \lambda/(2 \cdot v') \tag{23}$$

The required distance X to accomplish this bunching is then $$X = T \cdot V = \frac{\lambda}{2} \cdot \frac{V}{v'} \tag{24}$$

Or, $$\frac{X}{d} = \frac{1}{2S}\left(\frac{V}{v'}\right) \tag{25}$$

If it is assumed that in a practical device V/v') is between 0.02 and 0.10 and the optimum Strouhal number is between 0.2 and 1.2, such a device could be designed for any range of stand-offs between x/d=4 and 83. This range is of course dependent on the range (v'/V) selected.

It should be noted that the excited submerged cavitating vortex jet has its best operation when only a few diameters from the boundary. However, at very low cavitation numbers, good performance extends out to say 20 diameters or more.

The foregoing discussion teaches how high pressure jets, particularly submerged cavitating jets, can be made more effective in eroding a boundary material if the jet velocity is oscillated in the Strouhal number range of about 0.2 to 1.2. Within this range, I have found experimentally that by properly designing the nozzle contour, as will be discussed below, the critical Strouhal number for which the jet structures into discrete rings may be varied from about 0.3 to 0.8. The excitation amplitude need be only a few percent of the mean jet velocity. Higher amplitudes however will increase the erosion effectiveness. Any device capable of producing the excitation may be used. Examples of such devices are illustrated in FIGS. (*6a–6e*).

FIG. *6a* illustrates the most straightforward type of mechanical pulsing, that is, piston displacement. A piston 1 is oscillated upstream of the jet orifice 2 in a chamber such that the impedance in the direction of the main flow source is high and in the direction of the jet nozzle the impedance is low. An obvius amplification of the pressure oscillation at the nozzle can be achieved by establishing a standing wave reasonance in the system.

FIG. *6b* illustrates another mechanical pulsing concept involving oscillatory throttling of the flow supply to the nozzle. This concept might utilize a rotating valve 3. Proper sizing of the supply geometry may be used to set up resonance and thus amplify the magnitude of the oscillation of the jet flow.

FIG. *6c* illustrates another type of valve oscillator which does not require moving parts. The system utilizes fluid amplifier techniques such as the one illustrated to accomplish the oscillation. This device oscillates the flow back and forth about a splitter plate 4 as follows: flow on one side causes a positive pressure to be fed back through the return path (B' to A' or B to A); this positive pressure applied at the jet root forces the jet to the alternate path which then sends back a positive signal to force the jet back again to repeat the process. This type of oscillator is ideal for dividing and oscillating the flow between two nozzles and thus achieving an on-off type of oscillation.

FIG. *6d* illustrates the simplest possible acoustic oscillator pulsing device: an organ-pipe supply chamber. If the supply line is contracted at a distance L upstream of the final jet nozzle contaction, a standing wave whose length is approximately 2L/n (for the typical nozzle diameter contraction ratios of 2 to 4) will exist in this chamber when the pipe resonates; where n is the wave mode number. The wave amplitude is dependent on the energy content of flow oscillations corresponding to a frequency equal to cn/2L, where c is the speed of sound in the liquid. If the organ-pipe length is tuned to a frequency which is amplified by the jet, the oscillation will grow in amplitude and cause a strong jet pulsation. Preferably, the nozzle is designed as discussed below. The actual magnitude of amplification is best determined experimentally. This simple, self-excited acoustic oscillator appears well suited for taking advantage of the preferred jet structuring frequency discussed previously. Thus, a simple contracting nozzle of diameter $D_1$ designed as described below and fed by a pipe whose length L is approximately $D_1/2SM$ will tend to self-excite and produce discrete vortices when the jet is submerged or artifically submerged and the nozzle is properly designed. (S is the preferred Strouhal number and M is the Mach number.)

FIG. *6e* illustrates another version of an acoustic-hydrodynamic resonator in which the organ-pipe is replaced by the Helmholtz resonator 4. Such devices are discussed in detail below.

The methods shown in FIGS. *6c, 6d,* and *6e* may be termed pure fluid devices since they are entirely passive and require no outside energy supply. The energy for their operation comes only from the fluid and they depend on hydrodynamic and acoustic interactions for their operation.

The working fluid in most high-pressure jet erosion devices is water or water-based, with the speed of sound in the liquid being approximately 5,000 fps. The liquid velocity is usually greater than 500 feet per second (fps), although in some applications it may be less. For a Strouhal number of 0.45 the frequency required will then be greater than 225/d. The sound wavelength for this frequency is therefore shorter than 22.2 d. This short wavelength will tend to make an acoustic oscillator of some type particularly attractive, because such a geometrical size that can be readily incorporated in a nozzle system. For example, the simple organ-pipe device shown in FIG. *6d* should resonate in its first mode at the preferred frequency if its length is approximately one half of the sound wavelength, say 11 d for a 500 fps jet. Another particularly attractive oscillator is the jet-driven Helmholtz oscillator.

I have found that for Mach numbers (M) greater than 0.1, when the geometry of such an oscillator is properly selected, it will cause modulation of the jet speed within a particular Strouhal number range and with sufficient amplitude to cause discrete vortices to form in submerged cavitating jets and so produce the enhanced erosion effects described above. Details of the various embodiments of such high pressure nozzle systems, which are termed herein "Pulser" nozzles, are described below.

BASIC PULSER

Figure 7:
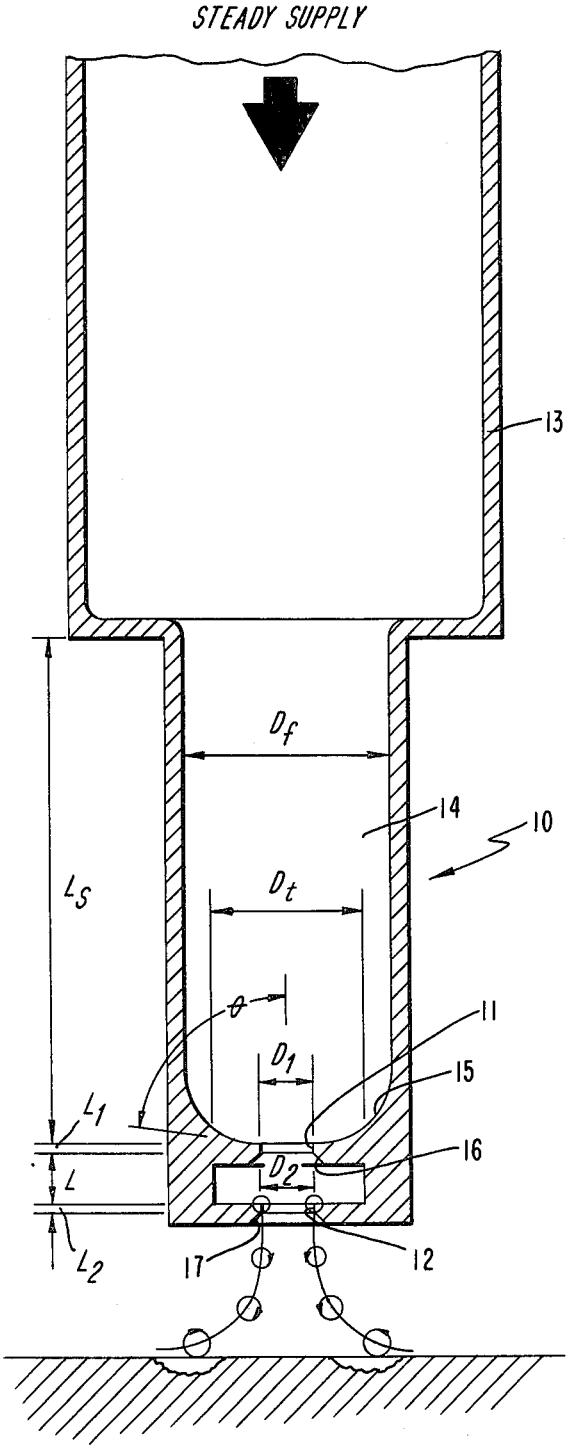
FIG. 7 shows a self-excited pulser nozzle used to improve submerged cavitating jet performance in accordance with the present invention.

FIG. 7 illustrates a specific nozzle system, referred to herein as the "Basic Pulser" nozzle system 10 designed to produce an oscillated liquid jet which structures itself into discrete vortices when submerged and thus cavitates and is more erosive than an unexcited jet. The oscillating exit velocity is produced by a hydrodynamic and acoustic interaction within a cavity volume formed by spacing two nozzles 11 and 12 in tandem an appropriate distance apart, and properly sizing the cavity volume.

In such a nozzle system, a steady flow of liquid is supplied from a supply line 13 to the nozzle system 10. The system 10 is comprised of an entrance section 14 having diameter $D_f$ and length $L_s$ terminating with a contraction from $D_f$ to $D_1$ with nozzle contour 15. An example of one preferred nozzle contour 15 is that shown for the conventional cavitating jet nozzle described in allowed U.S. patent application Ser. No. 931,244, the disclosure of which is hereby incorporated herein by reference to the extent required for a thorough understanding of the invention. The liquid passes through nozzle 11 having a straight length $L_1$, followed by a short tapered section 16. Further details of the preferred nozzle design are discussed below. The liquid jet then enters the cavity volume V, which in a cylindrical form has diameter $D_t$. Discrete vortices form in the shear zone between the jet and the cavity volume and exit through a second nozzle 12 having diameter $D_2$ and having a straight length $L_2$ followed by a short tapered section 17. The distance between the exit of the first nozzle 11 and the entrance of the second nozzle 12 is designated L. The principle of operation of the Basic Pulser nozzle is described below.

If the jet formed by nozzle 11 is excited at its optimum Strouhal number, discrete vortices will be formed and these vortices will have a frequency of $S_dV/d$ and a definite wavelength, λ, as discussed previously. If a second orifice 12 is placed downstream at a distance L, a vortex arriving at orifice 12 will transmit a pressure signal upstream to the exit of orifice 11 in a time=L/c. If the distance L is selected so that $L=N\lambda-(L/c)f\lambda$, where N is an integer number of vortices, the pressure signal will arrive at orifice 11 at exactly the time required to excite a new vortex. This equation may be expressed nondimensionally as $$\frac{L}{D_1} = \frac{N\lambda/D_1}{(1 + SM\lambda/D_1)} \tag{26}$$

where M is the Mach number, V/c.

The value of $\lambda/D_1$ may also be expressed as $1/S(V_c/V)$ where $V_c$ is the vortex convection velocity. Thus, equation (26) may also be written as $$\frac{L}{D_1} = \frac{N(V_c/V)}{S(1 + M\,V_c/V)} \tag{27}$$

I have found, in experiments with a mechanically excited water jet, that optimum generation of discrete vortices occurs at S=0.45 and 0.9. At this optimum condition, the observed value of $(V_c/V)$ was approximately 0.6. Prior art workers in air found that $(V_c/V)$ varied from 0.7 to 0.6 as S varied from 0.3 to 0.6. Thus, for design purposes, $(V_c/V)$ may be taken as 0.65. Equation (27) may then be approximated by $$\frac{L}{D_1} \cong \frac{.65N}{S(1 + .65M)} \tag{28}$$

The self-excitation caused by spacing the orifices according to equation (26) will be further amplified if the acoustic resonant frequency of the chamber volume is identical to the desired vortex frequency defined by the optimum Strouhal number.

The approximate equation for the cylindrical Helmholtz chamber resonant frequencies shown in FIG. 7 is $$f = \frac{c}{2\pi D_T}\sqrt{\frac{D_1}{L}} \tag{29}$$

The diameter ratio for the chamber may then be written in terms of the required Strouhal number and the Mach number as $$\frac{D_T}{D_1} = \frac{1}{2\pi SM}\sqrt{\frac{D_1}{L}} \tag{30}$$

where $D_1/L$ is given by equation (27) or (28).

If equation (28) is substituted into equation (30), the approximate equation for $D_T/D$, is $$\frac{D_T}{D_1} = \frac{.2}{M}\sqrt{\frac{1+.65M}{NS}} \tag{31}$$

Since practical, high speed jet applications require the Mach number to be generally 0.1 or higher, the required value of $D_T/D_1$ must be less than 2.06 NS. If the optimum Strouhal number of 0.45, as found in my experiments with free jets, is applied to the jet in the cavity volume, then $D_T/D_1$ must generally be 3.1 or less. The actual optimum Strouhal number will depend on the degree of contraction of the jet leaving nozzle 11 in FIG. 7. For example, if the nozzle contour has an exit slope nearly parallel to the axis of flow, then the optimum Strouhal number is near 0.35 (or 0.7 for the second mode). Then $D_T/D_1$, for $M=0.1$, must generally be 3.8 or less.

It is not necessary that the cavity volume be cylindrical in shape as shown in FIG. 7. It is only necessary that the volume be equivalent to the volume given by equations (30) or (31). Thus, $$\frac{\text{Vol}}{D_1^3} = \frac{\pi}{4}\left(\frac{D_T}{D_1}\right)^2\left(\frac{L}{D_1}\right) = \frac{1}{16\pi S^2M^2} \tag{32}$$

The value given by equation (32) for the case of $S=0.45$ and $M=0.1$ is 9.8.

One other feature of the Basic Pulser nozzle that is preferred for satisfactory operation is the proper selection of the diameter of nozzle 12. I have found that best results are obtained by using the following equation for design purposes.

$$\frac{D_2}{D_1} = .2\left(4 + \frac{L}{D_1} + \cos\theta\right) \tag{33}$$

where $\theta$ is the angle between the nozzle axis and the exit slope of the nozzle contour 15 in FIG. 7.

I have also found from experiments that the performance of the Pulser nozzle is usually improved if entrance section 14 is selected to have a length $L_s$ approximately equal to one quarter of the sound wavelength corresponding to the desired Strouhal number (or higher modules, $\frac{3}{4}$, 5/4 . . . ). Thus, $$\frac{L_s}{D_1} \simeq \frac{c}{4f} \simeq \frac{1}{4MS} \tag{34}$$

Although the diameter $D_f$ of the entrance section is not crucial to the operation of the Basic Pulser nozzle, as long as $D_f \geqq D_1$, it is preferred that $D_f/D_1$ be greater than 2. Although it need not be greater than 4.

I have also found that best performance is achieved when N is 1, 2 or 3 and preferably when $N=1$.

The following table summarizes the dimensions and dimensional ratios typical of practical Basic Pulser nozzles designed in accordance with the present invention for high pressure liquid jet applications where the Mach number is greater than 0.08, and usually in the range 0.1 to 0.3.

| Dimension Or Dimensional Ratio | Typical Values | Equation No. |
|---|---|---|
| $D_1$ | <20 mm typically <10 mm | – |
| $\frac{D_f}{D_1}$ | 1 to 6, preferably 2 to 4 | – |
| $\frac{D_2}{D_1}$ | .0 to 1.4 | 33) |
| $\frac{D_T}{D_1}$ | <4.0, typically <3.5 (Mach number 0.1) | 30) |
| $\frac{\text{Vol}}{D_1^3}$ | <14.0, typically <10 (Mach number 0.1) | 32) |
| $\frac{L_1}{D_1}$ | preferably near 0 | – |
| $\frac{L}{D_1}$ | 0.5 to 6.0, preferably 0.5 to 2.0 | 28) |
| $\frac{L_2}{D_1}$ | <1.0, preferably near 0 | – |

I have tested the Basic Pulser nozzle in both air and water and found that rms velocity fluctuations as high as 0.5 were obtained, and that both cavitation inception and erosion of a boundary were considerably greater than for simple, non-excited jets.

Contrary to prior art teachings which would tend to discourage the use of such a pulser nozzle at Reynolds numbers higher than $10^4$ and at Mach numbers greater than 0.1, and more particularly at values of $D_T/d_1 < 4$ or $\text{Vol}/D_1^3 < 14$, I have found that the Basic Pulser nozzle system described above produces precisely the effect needed for enhanced cavitation when designed within the ranges specified above.

I have further found, in some applications of the form of the Basic Pulser nozzle, for example in the extended nozzles of some conventional roller drill bits, the value of $D_T/D_1$ may be constrained to be as small as about 2.0. I have found that even for this small value, a form of the Basic Pulser nozzle system can be designed to operate successfully. For these constrained applications another embodiment of the invention, referred to herein as the "Laid-Back Pulser" nozzle may be preferred.

LAID-BACK PULSER

Figure 8:
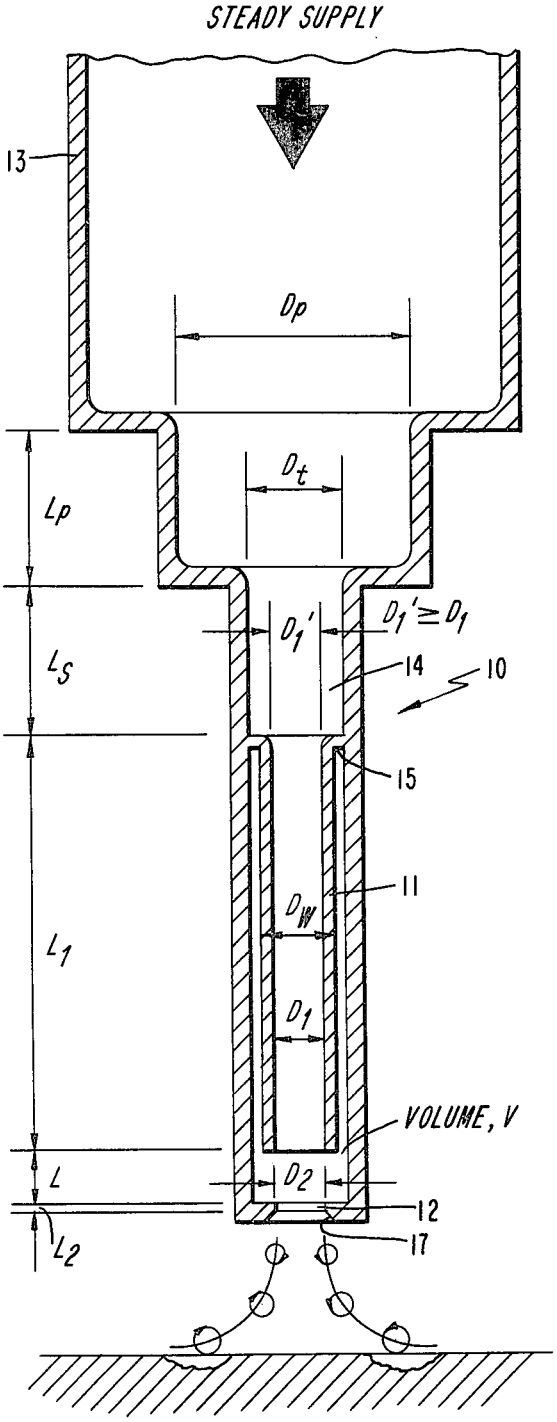
FIG. 8 shows a further embodiment of a self-excited pulser nozzle constructed in accordance with the present invention.

FIG. 8 illustrates another embodiment of the Pulser system which has been found to be satisfactory when the value of $D_T/D_1$ is constrained so as to be not achievable by applying the basic Pulser design principles discussed above. In the Laid-Back Pulser, the value of $\text{Vol}/D_1^3$ given by equation (32) is achieved by lengthening the value of $L_1$ sufficiently to add the required volume in the annular space around the resulting long nozzle. For example, if $D_1'=D_1, L_1/D_1$ may be obtained from the following equation.

$$\frac{Vol}{D_1^3}=\frac{\pi}{4}\left[\left(\frac{D_T}{D_1}\right)^2-\left(\frac{D_W}{D_1}\right)^2\right]\frac{L_1}{D_1}+\frac{\pi}{4}\left(\frac{D_T}{D_1}\right)^2\frac{L}{D}\cong\frac{1}{16\pi S^2M^2} \quad (35)$$

In the Laid-Back Pulser embodiment shown in FIG. 8, a steady flow of liquid is supplied from a supply line 13 to the nozzle 10. The supply line 13 may have several steps, as shown, to reach the constrained diameter $D_t$. One such step might be through diameter $D_f$. Such a step would be useful in reducing the pipe losses between the supply 13 and the nozzle 10 if the distance $L_p$ is very large. The nozzle 10 is comprised of an entrance section 14 having the constrained diameter $D_f=D_t$ and length $L_s$ terminating in a contraction 15 from $D_T$ to entrance diameter $D_1'$. The liquid then passes through nozzle 11 having a length $L_1$ and an exit diameter $D_1$ (where $D_1'\geqq D_1$). The liquid jet then enters the cavity volume V, which has the constrained diameter $D_t$. Discrete vortices form in the shear zone between the jet and the cavity volume and exit through a second nozzle 12 having a diameter $KD_2$ and having a straight length $L_2$ followed by a short tapered section 17. The distance between the exit of the first nozzle 11 and the entrance of the second nozzle 12 is designated L. The cavity volume V has a total length of $L+L_1$ and is given by equation 35, which depends on the outer diameter $D_w$ of nozzle 11.

The principle of operation of the Laid-Back Pulser is the same as that described for the basic Pulser.

Such a Laid-Back Pulser has been designed for M=0.1 and tested in air. Jet velocity rms amplitudes as high as 30% of the mean velocity were measured. Such a nozzle, when tested in water, should also produce enhanced cavitation characteristics. I found that for the specific design tested, that if $D_f=20$ cm, $D_1=8$ mm, and $D_T/D_1=2$, $L_1/D_1=8$, resonance could be achieved in the first three modes, i.e., $L/D_1=1, 2, 3$.

The following table summarizes the dimensions and dimensional ratios typical of practical Laid-Back Pulser nozzles designed for high pressure liquid jet applications where the Mach number is greater than 0.08, and usually in the range 0.1 to 0.3.

| Dimension or Dimensional Ratio | Typical Values | Equation Number |
|---|---|---|
| $D_1$ | <20 mm, typically <10 mm | — |
| $D_f/D_1$ | $= D_T/D_1$, typically <3 | — |
| $D_2/D_1$ | 1 to 1.4 | (33) |
| $D_T/D_1$ | typically <3 | — |
| $Vol/D_1^3$ | <14.0, typically <10 (M >0.1) | (32), (35) |
| $L_1/D_1$ | >0, typically 1.0 to 20.0 | (35) |
| $L/D_1$ | 0.5 to 6.0, preferably 0.5 to 2.0 | (28) |
| $L_2/D_1$ | <1.0, preferably near 0 | — |

PULSER-FED

Either the Basic Pulser nozzle or the Laid-Back Pulser nozzle, as shown in FIGS. 7 and 8, respectively, will oscillate the flow so as to improve the cavitating performance of a submerged or artificially submerged jet, or cause the impact erosion of a jet in air to improve because of the intermittent percussive effect. However, I have found that the vortices (in a submerged jet) are more precisely formed if the pulser (resonator) chamber which produces the excitation is formed some distance from the exit nozzle, rather than actually functioning as the discharging nozzle. Such a pulser device is denoted herein as "Pulser-Fed" and is illustrated in FIG. 9.

There are three advantages to the Pulser-Fed nozzle configuration.

These are:

(1) The amplitude of the modulation may be established by the proper choice of the configuration of the diffusion chamber 18 which is situated in tandem with the pulser.

(2) The radial velocity distribution across the jet forming discharge nozzle can be made more uniform and thus the vortices or slugs formed are more cleanly defined.

(3) The pulser may be selected to operate at a higher Strouhal number than that of the discharge orifice and thus the pressure inside the resonator chamber can be made higher than the ambient pressure to which the final jet forming nozzle discharges. Also the jet velocity in the resonator chamber is lower than the final jet velocity. Thus the cavitation number in the pulser is much higher than the final jet cavitation number and the chamber can be designed to operate cavitation free even when the cavitation number at the free jet is nearly zero.

The disadvantage of the Pulser-Fed system is that the overall energy loss (caused by losses in the diffusion chamber) is greater than for a Basic or Laid-Back Pulser configuration. These losses may be minimized by using the alternate diffusion chambers shown in FIGS. 9*b* and 9*c*.

Figure 9A:
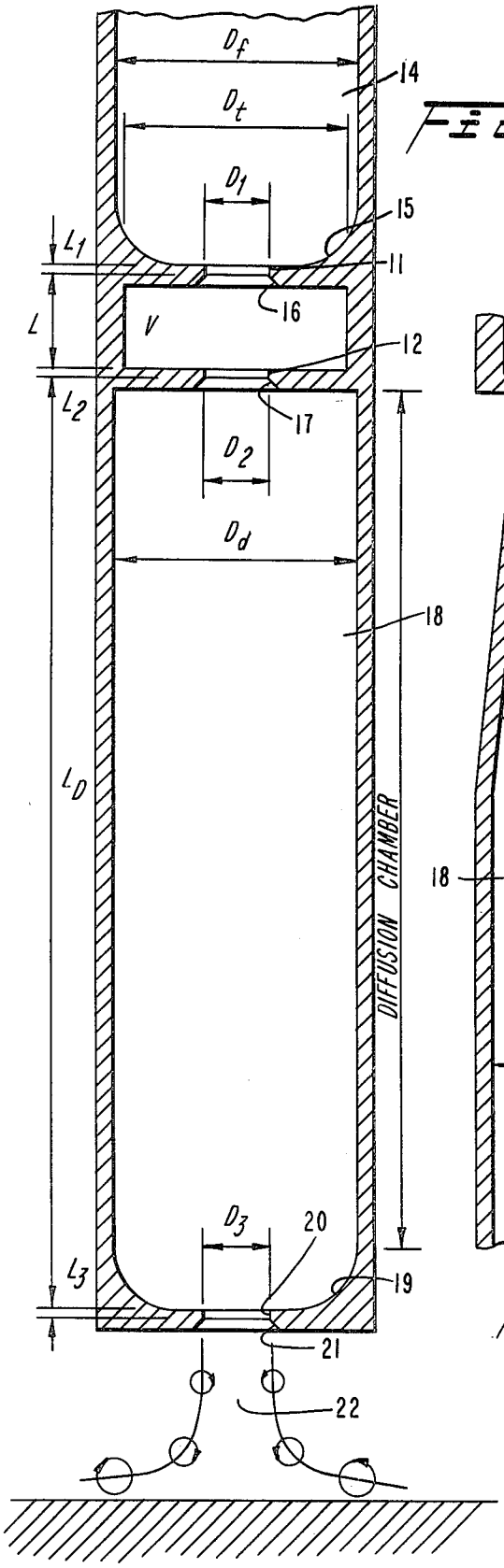
FIG. 9 shows further embodiments of a self-excited pulser nozzle constructed in accordance with the present invention.

In the Pulser-Fed embodiment of the invention shown in FIG. 9*a* a liquid passes from a supply into the entrance section 14 of diameter $D_f$ terminating with a contraction from $D_f$ to $D_1$ with nozzle contour 15. The liquid passes through nozzle 11 having a straight length $L_1$ followed by a short tapered section 16. The liquid jet then enters the cavity volume V, which in a cylindrical form has diameter $D_T$. Discrete vortices form in the shear zone between the jet and the cavity volume and exit through a second nozzle 12 having diameter $D_2$ and having a straight length $L_2$ followed by a short tapered section 17. The distance between the exit of the first nozzle 11 and the entrance of the second nozzle 12 is designated L. It will be recognized that this portion of the Pulser-Fed nozzle is exactly the pulser nozzle shown in FIG. 7 and previously described. Although not shown, it will be clear that another embodiment of the invention is a Laid-Back Pulser-Fed configuration in which the feeding Pulser nozzle of FIG. 9*a* is replaced by a Laid-Back Pulser nozzle.

In the Pulser-Fed embodiment shown in FIG. 9*a* liquid passes from nozzle 12 into a diffusion chamber 18 having diameter $D_d$ and length $L_d$. The liquid then enters a contraction section from diameter $D_d$ to $D_3$ through a nozzle contour 19. An example of one nozzle contour preferred for use as contour 15 and contour 19 is that shown for the conventional cavitating jet nozzle described in U.S. patent application Ser. No. 931,244. Further details of the preferred nozzles 15 and 20 are described below. The liquid then passes through exit nozzle 20 having a diameter $D_3$ and a straight length $L_3$ followed by a short tapered section 21.

The principle of operation of the Pulser-Fed nozzle upstream of the exit of pulser nozzle 12 is the same as previously described for the basic Pulser. The jet discharging from nozzle 12 oscillates or pulses as it enters chamber 18. This piston-like oscillation is transmitted hydrodynamically and acoustically to the nozzle 20 and excites the discharge from the nozzle 20 at the same frequency as the pulser frequency. The amplitude of the excitation at exit nozzle 20 is less than the amplitude of the Pulser jet because of attenuation in chamber 18. The excitation in chamber pressure at nozzle 20 causes structuring of the jet into discrete vortices if the Strouhal number of the exit jet $S=fD_3/V_3$, based on the exit nozzle diameter $D_3$ and the exit velocity $V_3$, is near the optimum value. My experiments have shown that the Pulser-Fed nozzle does result in discrete vortices that are more well-defined and not as irregular as those generated by the Basic Pulser or Laid-Back Pulser. The reason for this is that the diffusion chamber provides a uniform inflow to exit nozzle 20.

Although the Pulser-Fed nozzle may be designed with the pulser Strouhal number identical to the exit nozzle Strouhal number, in order to achieve the well-defined vortex flow in the exit; an additional important feature of the Pulser-Fed nozzle is achieved when the Strouhal number of the pulser nozzle 12 is taken as twice the optimum Strouhal number of the exit nozzle 20.

As discussed previously, I have found in experiments in water that the optimum Strouhal number for the achievement of discrete vortices is 0.45 with a reoccurence of the phenomenon at twice this value 0.90 for the particular nozzle tested.

If the pulser nozzle Strouhal number is taken as twice the exit jet Strouhal number the pulser entrance nozzle 11 diameter $D_1$ will be larger than the exit nozzle 20 diameter $D_3$ and thus the average pressure within the pulser will be higher than the ambient pressure, $P_a$, at the exit jet and the pulser jet velocity will be lower than the exit jet velocity. Thus the local operating cavitation number within the pulser section will be higher than the operating cavitation number of the exit jet. This effect is so great that it generally suppresses cavitation within the Pulser section even when the exit jet operating cavitation number is nearly zero. A further advantage of this type design ($S_{D1}=2S_{D3}$) is that the energy loss in the diffusion chamber 18 is greatly reduced (for a given exit velocity) because the pulser jet velocity is lower than the exit jet velocity.

Thus the preferred configuration of the Pulser-Fed nozzle is determined by choosing the pulser Strouhal number to be twice that of the exit Strouhal number. That is, $$\frac{fD_1}{V_1} = 2\frac{fD_3}{V_3}, \frac{D_1}{V_1} = \frac{2D_3}{V_3} \tag{36}$$

From the continuity equation, $$C_{D1}V_1D_1^2 = C_{D3}V_3D_3^2 \tag{37}$$

where $C_{D1}$, and $C_{D3}$ are the discharge coefficients of nozzle 11 and 20 respectively.

Combining equations (36) and (37) gives $$\frac{V_1}{V_3} = \frac{M_1}{M_3} = \left(\frac{1}{4}\frac{C_{D3}}{C_{D1}}\right)^{\frac{1}{2}} = .63\left(\frac{C_{D3}}{C_{D1}}\right)^{\frac{1}{2}} \tag{38}$$

and $$\frac{D_1}{D_3} = 2\left(\frac{1}{4}\frac{C_{D3}}{C_{D1}}\right)^{\frac{1}{2}} = 1.26\left(\frac{C_{D3}}{C_{D1}}\right)^{\frac{1}{2}} \tag{39}$$

If nozzle contours 15 and 19 are similar in shape and have contraction ratios $D_f/D_1$ and $D_d/D_3$ that are not greatly different, $C_{D3}$ may be assumed equal to $C_{D1}$ for preliminary design purposes. Otherwise $C_{D1}$ and $C_{D3}$ must be obtained from Handbook values or experiment for the particular nozzle contours used.

The oscillating pressure field at the Pulser exit nozzle 12 is best transmitted if the length of the diffusion chamber 18 is selected so as to be near resonance. This length $L_D$ is best selected by experiment, but for preliminary design purposes the length $L_D$ should be selected to be approximately one-half the acoustic wavelength.

Thus, $$L_D \approx D/2SM \tag{40}$$

The following table summarizes the dimensions and dimensional ratios typical of practical Pulser-Fed nozzles designed for high pressure liquid jet applications where the exit Mach number, $M_3$, is greater than 0.08 and usually in the range 0.1 to 0.3.

| Dimension or Dimensional Ratio | Typical Values | Equation Number |
|---|---|---|
| $D_3$ | <20mm, typically <10mm | — |
| $D_1/D_3$ | 1.0 to 1.5, preferably 1.26 | (39) |
| $D_f/D_1$ | 1.0 to 6, preferably 2 to 4 | |
| $D_2/D_1$ | 1.0 to 1.4 | (33) |
| $D_T/D_1$ | <6.0, typically <5.0 ($M_3$ = 0.1) | (30), (38) & $S = 2S_{D3}$ |
| $Vol/D_1^3$ | <35, typically <25 ($M_3$ = 0.1) | (32), (38) & $S = 2S_{D3}$ |
| $L_1/D_1$ | Preferably Near Zero | |
| $L/D_1$ | 0.5 to 6.0, preferably 0.5 to 2.0 | (28), (38) & $S = 2S_{D3}$ |
| $L_2/D_1$ | <1.0, preferably near 0 | |
| $D_d/D_2$ | >1.2, preferably 1.2 to 3.0 | |
| $L_d/D_d$ | 5.0 to 10.0 | (40) |
| $L_3/D_3$ | Preferably Near Zero | |

It should be recognized that a Laid Back Pulser-Fed embodiment may be designed by substituting a Laid-Back Pulser for the pulser described above.

It is clear that the energy loss associated with the Pulser-Fed nozzle may be reduced by using a conical rather than a cylindrical diffusion chamber. Two versions of alternate diffusion chambers are shown in FIGS. 9b and 9c.

Figure 9B:
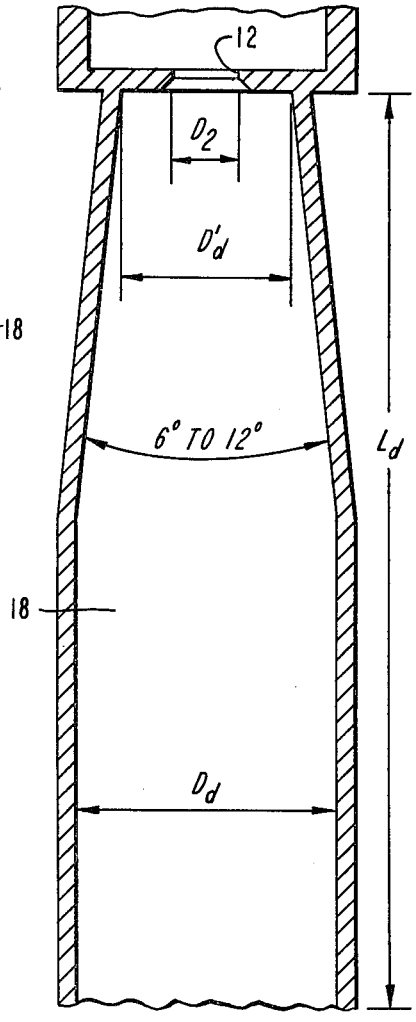

In FIG. 9b the diffusion chamber 18 consists of a conical section starting with diameter $D_d'$ and expanding to the diameter $D_d$ through a 60° to a 12° cone.

Figure 9C:
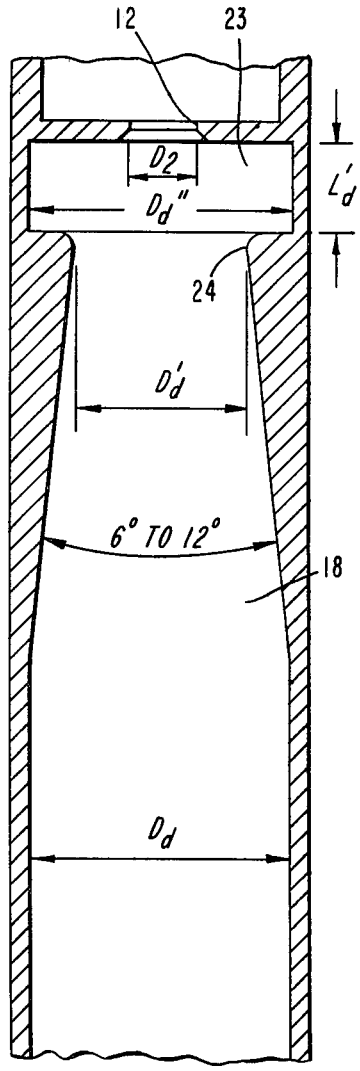

In FIG. 9c the nozzle 12 is followed by a chamber 23 having diameter $D_d''$ and length $L_d'$. The flow then passes into a 6° to 12° cone through a rounded inlet having diameter $D_d'$. The conical section terminates in a cylindrical section having diameter $D_d$. The preferred value of $D_d''/D_d$ and $L_d'/D_2$ is approximately 1.0. The preferred range of $D_4'/D_2$ is 1.2 to 2.0.

ORGAN-PIPE ACOUSTIC OSCILLATOR

The organ-pipe, acoustic oscillator embodiment illustrated in FIG. 6d was discussed briefly above. This method of supplying a jet forming nozzle so as to achieve self excitation and thus the formation of discrete ring vortices in a submerged jet is particularly useful when applied in the extended arms or tubes which supply the cleaning jets used in conventional two and three cone roller bits (See FIG. 18). Such bits are used, for example, in drilling oil and gas wells. This embodiment may also be incorporated in the cleaning jet system of other mechanical drilling bits or any type of submerged jet system. When used in this manner, the organ-pipe acoustic oscillator of the present invention will improve the drilling rate of mechanical bits by causing the jets to self excite and thus produce the desirable results caused by the structuring of the jets into ring vortices as discussed herein.

FIGS. 10a, 10b, 10c, 10d, 10e, 10f, and 10g illustrate various types of organ pipe configurations constructed in accordance with the invention which have been subjected to analysis and experiment. My acoustic analysis and experiments conducted in air and water may be approximated by the following equations which relate the overall length of the supply tube L and the exit orifice diameter D to the Strouhal number, S, the mode number N, and the design Mach number M.

$$L/D \simeq K_n/MS \tag{40}$$

$$K_n = FCN\left\{N_1\left(\frac{Ds}{Df}\right)^2\left(\frac{Df}{D}\right)^2\right\}$$

$$\simeq \frac{2N-1}{4} \text{ for } \left(\frac{Ds}{Df}\right)^2 \text{ and } \left(\frac{Df}{D}\right)^2 >>> 1 \tag{40a}$$

$$\simeq \frac{N}{2} \text{ for } \left(\frac{Ds}{Df}\right)^2 >> 1, \text{ but } \frac{Df}{D} \lesssim 4 \tag{40b}$$

For most practical cases (for example, in the extended tubes of roller bits used for deep hole drilling, e.g., oil and gas drilling) Equation 40(b) is applicable. My experiments show that, for the case where Equation (40b) is applicable, a slightly better empirical approximation for the desired relationship is $$M \simeq \frac{N}{2S}\left[\frac{D}{L} - 0.86\left(\frac{D}{L}\right)\right]^2 \tag{41}$$

Figure 10A:
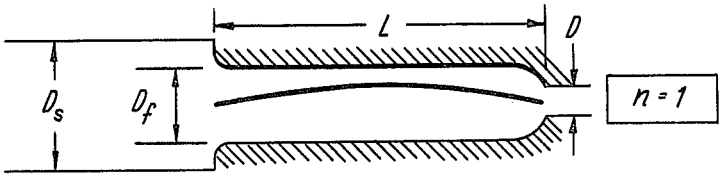
FIGS. 10*a*, 10*b* and 10*c* show a series of organ pipe oscillator configurations with the standing wave patterns for modes 1, 2 and 3, respectively.
Figure 10D:
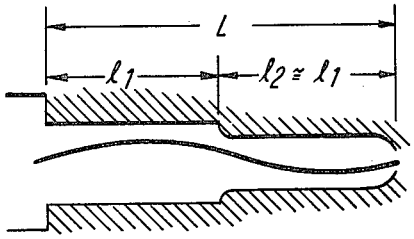
FIGS. 10*d*, 10*e*, 10*f* and 10*g* show a series of organ pipe oscillator configurations with preferred stepped changes in area and showing standing wave patterns for mode 2 (FIG. 10*d*) and mode 3 (FIGS. 10*e*, 10*f* and 10*g*)
Figure 10B:
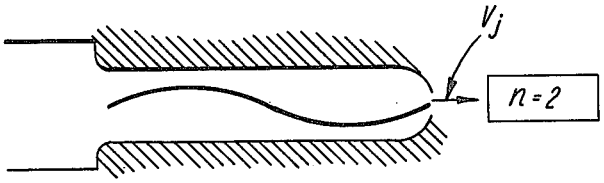
Figure 10E:
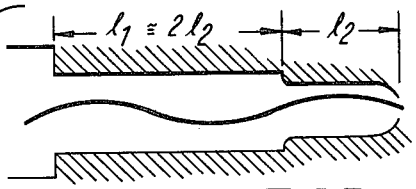
Figure 10C:
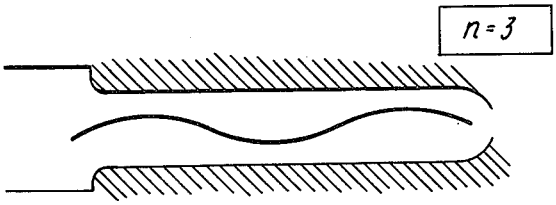
Figure 10F:
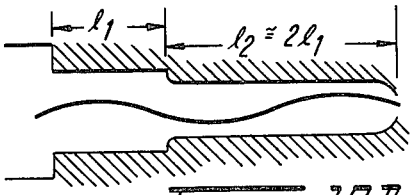
Figure 10G:
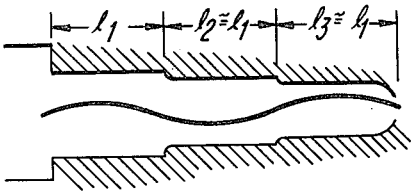

Equation 41 is applicable for all values of N where there are no intermediate changes in area along the length L, such as shown, for example, in the constant area tube illustrated in FIGS. 10a, 10b, 10c. The waveform for mode numbers (N) 1, 2, 3 are shown in FIGS. 10a, 10b and 10c, respectively. I have found, through analysis and experiment, that Equation 41 is also applicable to those cases where changes in area may be required or desired along the length L. However, my experiments and analysis show that strong pure resonances will not be achieved in such stepped systems unless the steps are located approximately at the wave nodes. FIGS. 10d, 10e, 10f, and 10g illustrate such preferred systems.

Figure 11:
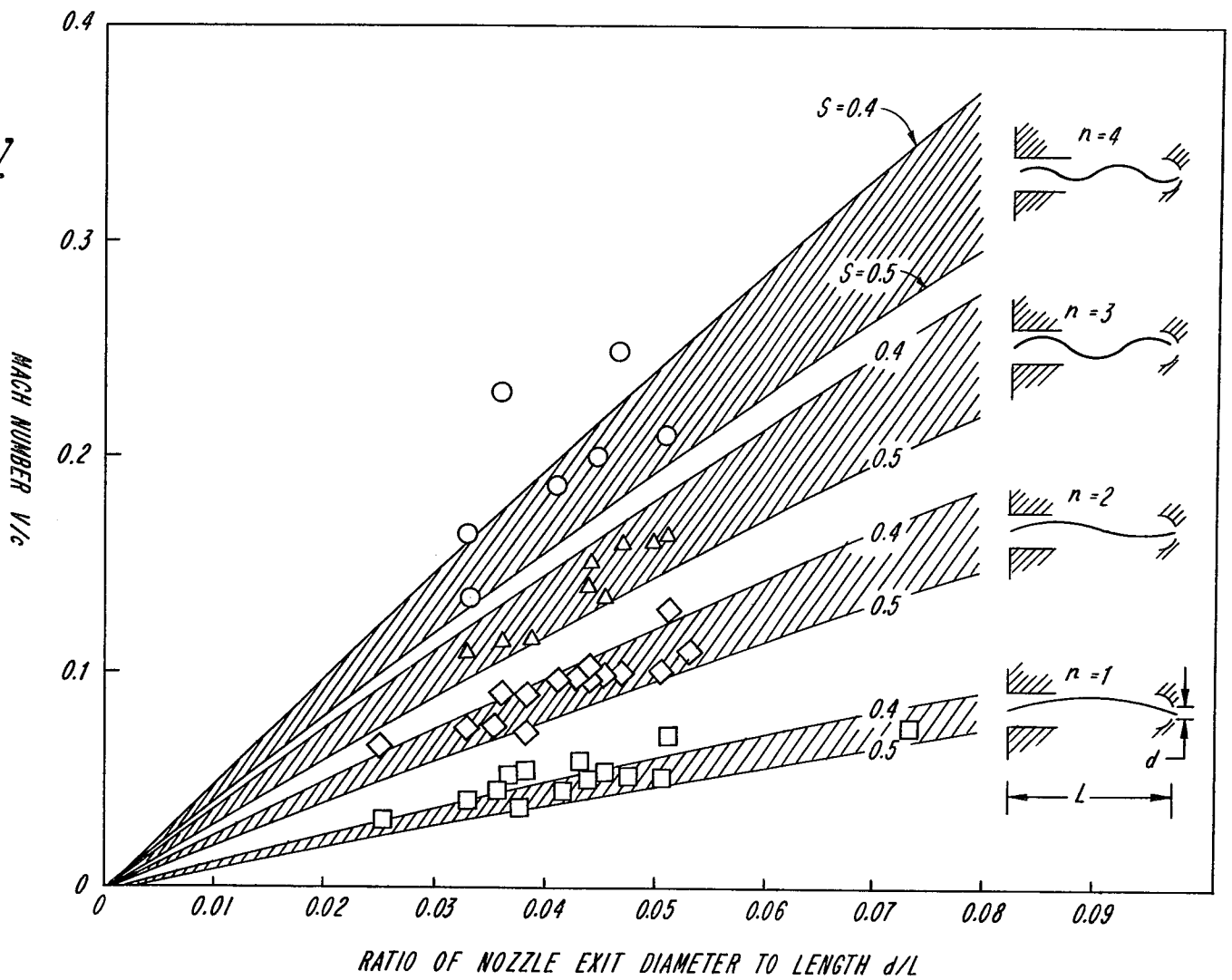
FIG. 11 is a graph showing the relationship between Mach number, D/L, S and mode numbers, N, and showing the correlation with observed experimental data.

FIG. 11 is a comparison of the results given by Equation 41 for modes 1, 2, 3, and 4, and for values of S between 0.4 and 0.5, and my observations during experiments conducted in air which indicated when the jet was structured into periodic vortices. The points shown represent combinations of M and D/L where the jet was structured, as observed from a hot wire anemometer located on the jet centerline. In these tests the tube length was 8.5 in (21.59 cm) and $D_S/D_f=1$. One configuration was similar to FIGS. 10a, 10b, 10c, with $D_f=0.625$ inches (1.59 cm) and D=0.30 and 0.35 inches (7.6 and 8.9 mm). Another configuration was similar to FIG. 10d, with $D_f=1.06$ inch (2.69 cm), $D_f,1=0.625$ inch (1.59 cm) and D=0.30 and 0.35 inches (7.6 and 8.9 mm). A third configuration was similar to FIG. 10e and having dimensions identical to the above-described FIG. 10d configuration, except for the location of the step. In nearly all cases the observed Strouhal number when jet structuring occurred was approximately 0.5, while in every case the Strouhal number when jet structuring occurred was between 0.4 and 0.6. As shown in FIG. 11, the agreement between my observations and predictions from Equation 41 was very good except for scattered results in the fourth mode.

Figure 20:
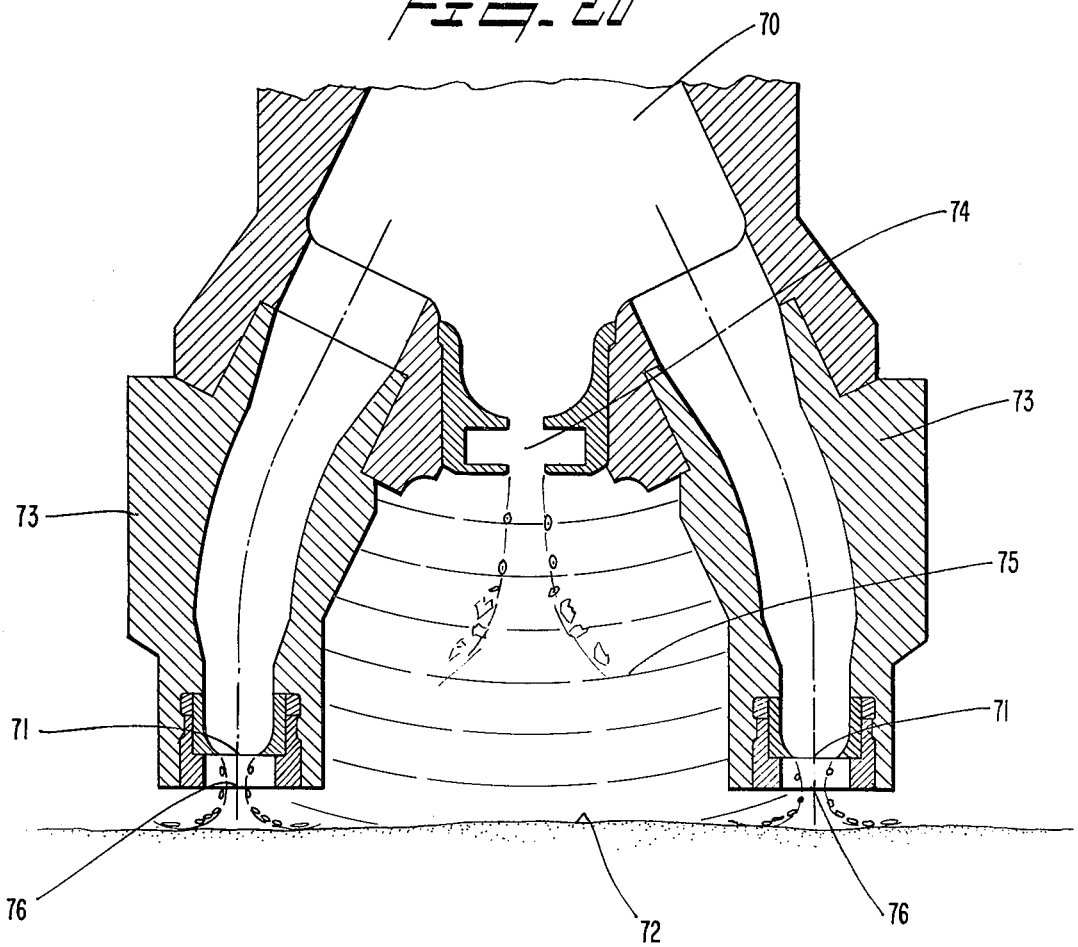
FIG. 20 is a schematic drawing showing the extended arms, cavitating jets, and pulser nozzle used in a two or three cone roller bit for use in drilling in accordance with a further embodiment of the invention.

FIG. 20 shows typical existing roller-bit extended arm, curved tubes which supply high speed jets to the hole bottom for cleaning. Tests using similarly constructed conventional bits supplied with air have been carried out and it was found that Equation 41 predicts the conditions for jet structuring for such jets when properly designed jet forming nozzles are used. Design of the jet forming nozzles is discussed in detail below. Thus, the curvature in the tubes of conventional bits does not influence the application of Equation 41 and the principles illustrated in FIGS. 10a, 10b, 10c, 10d, 10e, 10f, 10g and discussed herein. In the design of a roller bit extended arm system (or any other organ-pipe, acoustic oscillator) in accordance with the present invention, the following parameters and design factors should be considered. Given the nozzle pressure drop, ΔP, fluid density, $\rho$; fluid sound speed c; and nozzle exit diameter, D (or discharge), suitable lengths of a constant diameter supply tube that will self excite and structure into discrete vortices (assuming a proper nozzle is used) must be determined. First, the design Mach number, $$M = \sqrt{\frac{2\Delta\rho}{\rho}}\ /C$$

should be calculated. Then, find from Equation 41, or FIG. 11, values of D/L for each mode number, and thus L for each mode number. Select the most suitable mode and corresponding length. If a higher mode design is selected and steps in diameter are desired, follow the principles discussed and shown above in connection with FIGS. 10d, 10e, 10f, and 10g.

In multiple orifice designs (for example, the two or three nozzle systems used with conventional two and three cone roller bits), it may be possible to supply the total discharge to the hole bottom with an unequal division between the nozzles. Thus, for fixed length tubes, if equal size jets result in a value of D/L for which self excitation is not possible at the design Mach number, it may be possible to select two nozzles smaller than the third (but passing the total design discharge), with the smaller nozzles self exciting at a higher mode than the third nozzle. Furthermore, it is possible to choose slightly different design Mach numbers for each combination of nozzles so as to widen the range of operating pressure drops over which the system can operate with at least one nozzle excited at all times. Such an arrangement will require a screening device in the plenum supply to the larger nozzle to prevent large particles from feeding back into the smaller nozzles during shut-downs.

Configurations similar to those shown in FIGS. 10*a*, 10*b*, 10*c* and 10 *e* were tested in a pressure cell using water, for cavitation numbers from 0.5 to 1.5. Observations were made of acoustic pressure fluctuations within the flow system, the jet cavitation patterns, incipient cavitation number and erosion intensity when the jet impinged against Indiana limestone. The results of these tests may be summarized as follows:

(1) Resonance, as indicated by pressure fluctuations measured in the supply pipe and in the discharge chamber, occurred at Mach numbers in agreement with predictions based on theory and the experiments in air.

(2) When resonance occurred, the incipient cavitation number approximately tripled.

(3) Cavitation occurred in the core of well defined ring vortices convecting at approximately ⅔ of the jet speed and having a spacing approximately equal to the orifice diameter.

(4) The Strouhal number at which resonance and structuring occurred was approximately 0.45 for the nozzles tested.

(5) For a 0.25 inch diameter nozzle tested in water in a pipe system similar to that shown in FIG. 10*e*, where the jet was impinged against Indiana limestone, the erosion measured at a cavitation number of 0.1 and a nozzle pressure drop of 1500 psi may be compared with erosion obtained under identical conditions for a nozzle system in which resonance and jet structuring did not occur as follows:

(a) Width of eroded path approximately 5 jet diameters for both nozzles.

(b) Depth of eroded path for the structured jet approximately 5 to 8 times as great as the path of an unstructured jet.

Numerous other configurations having different lengths and stepped area changes, with varying nozzle designs, were tested in water and confirmed the higher incipient cavitation number and greater erosivity of resonating jets structured into discrete ring vortices. Furthermore, visual observations and photographs which were taken confirmed the flow pattern shown in FIG. 4*b*, which illustrates the structured pattern that is sought for improved jet erosion properties. As will be discussed in detail below, this structured pattern will result in improved cleaning at the bottom of deep holes drilled for oil and gas, even at depths great enough to prevent the cavitation effect.

FORCED EXCITATION EXPERIMENTS

In order to confirm that a submerged liquid jet would structure itself into discrete ring vortices if the jet is excited at the proper Strouhal number, and furthermore, that cavitation would be incipient in these discrete vortices at higher incipient cavitation numbers than for an unexcited jet, experiments were carried out.

Figure 12:
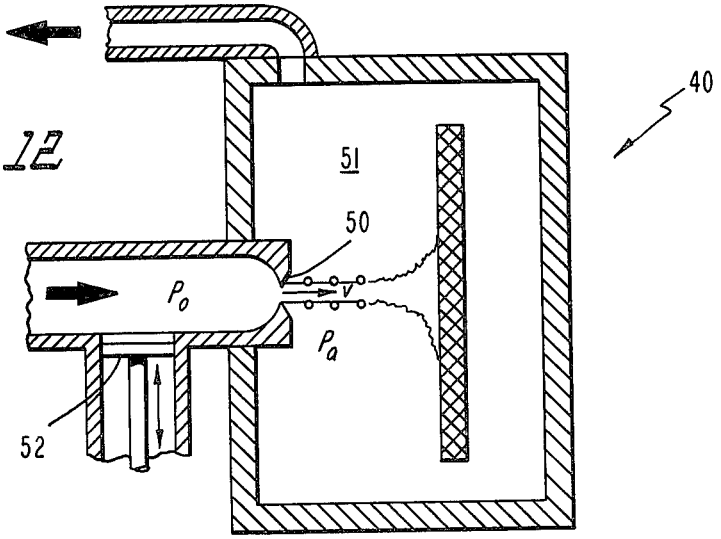
FIG. 12 is a schematic diagram illustrating a test rig used to demonstrate certain principles of the present invention.

A recirculating water tunnel 40 was constructed in such a way as to mechanically oscillate the flow from a submerged jet issuing from a ¼" diameter orifice. A schematic diagram of the test set-up is shown in FIG. 12. A jet having mean velocity V issued from the nozzle 50 having an upstream pressure $P_o$ into a chamber 51 having a pressure $P_a$. The value of $P_o$ and $P_a$ could be varied so as to vary the jet velocity V and the cavitation number, $\sigma$. Oscillations of a selected frequency and amplitude were superimposed on the upstream pressure $P_o$ by mechanically oscillating the piston 52 shown in the supply line.

Figure 13A:
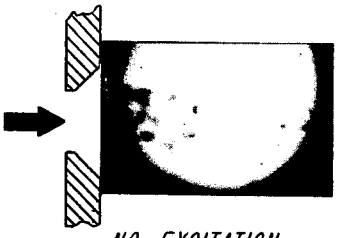
FIGS. 13*a*, 13*b* and 13*c* illustrate a comparison of the cavitation patterns observed in the test rig shown in FIG. 12 with and without excitation of a submerged liquid jet.
Figure 13B:
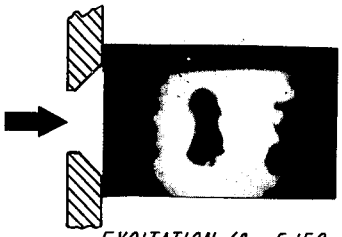
Figure 13C:
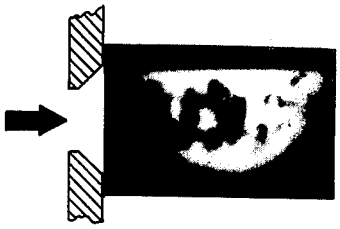

It was found that, when the cavitation number was sufficiently below the inception value so that cavitation was visible, excitation of the jet at amplitudes of several percent of $(P_o-P_a)$ resulted in dramatic changes in the appearance of the cavitation when the Strouhal number was 0.45. This structuring of the jet into discrete vortices was again observed when the Strouhal number was 0.9. A typical photograph of the change in cavitation pattern with excitation is shown in FIGS. 13*a*, 13*b*, and 13*c*. FIG. 13*a* shows the pattern for no excitation, while FIGS. 13*b* and 13*c* show the pattern when the jet was excited at frequencies of 5156 Hz and 10,310 Hz respectively. The jet velocity was 76.36 m/sec. (221 fps) and $\sigma=0.23$. FIGS. 13*b* and 13*c* thus correspond to Strouhal numbers of 0.45 and 0.90.

Figure 14:
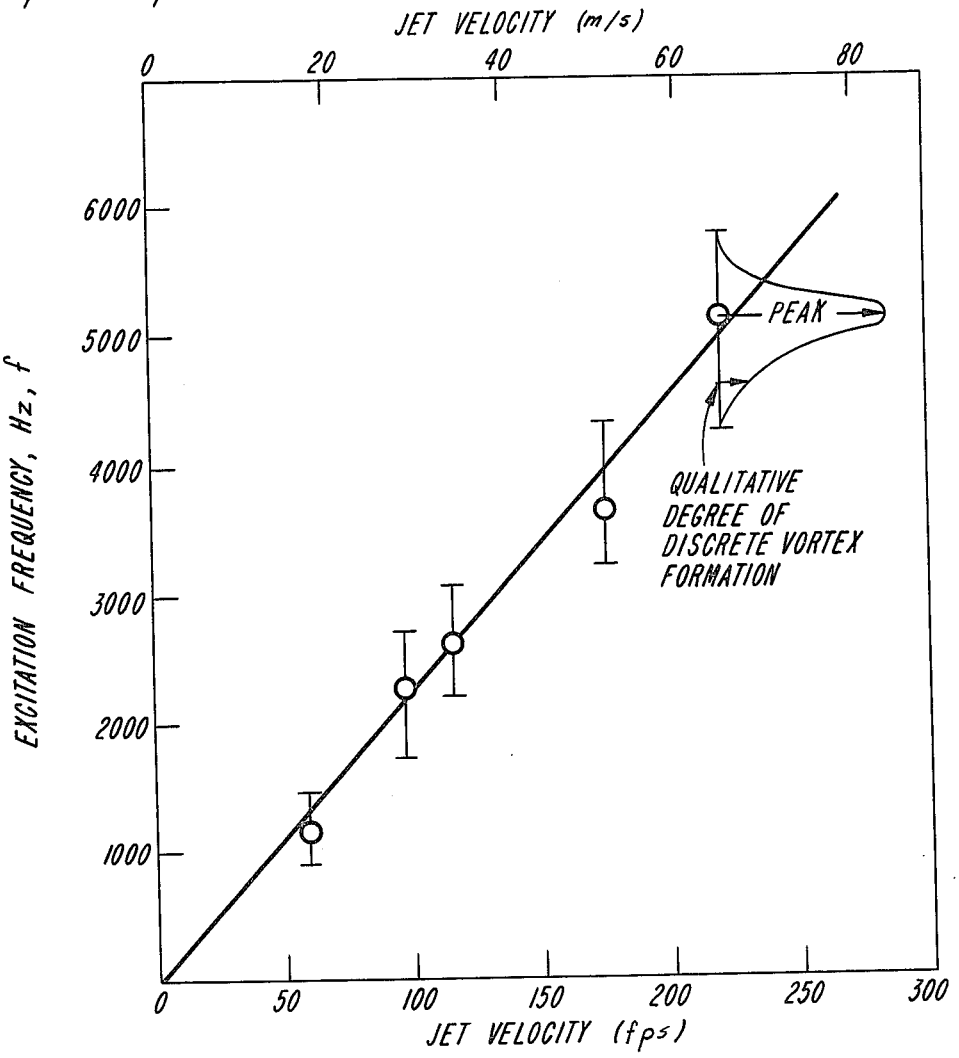
FIG. 14 is a graph showing the observed relationship between the excitation frequency and the jet velocity in the formation of discrete vortices.

FIG. 14 shows the observed relationship between the excitation frequency and the jet velocity for which there was a high degree of discrete vortex formation in experiments testing the system shown in FIG. 12. The line through the data corresponds to a Strouhal number of 0.45. Similar data were found for twice this value of Strouhal number, S=0.9.

Figure 15:
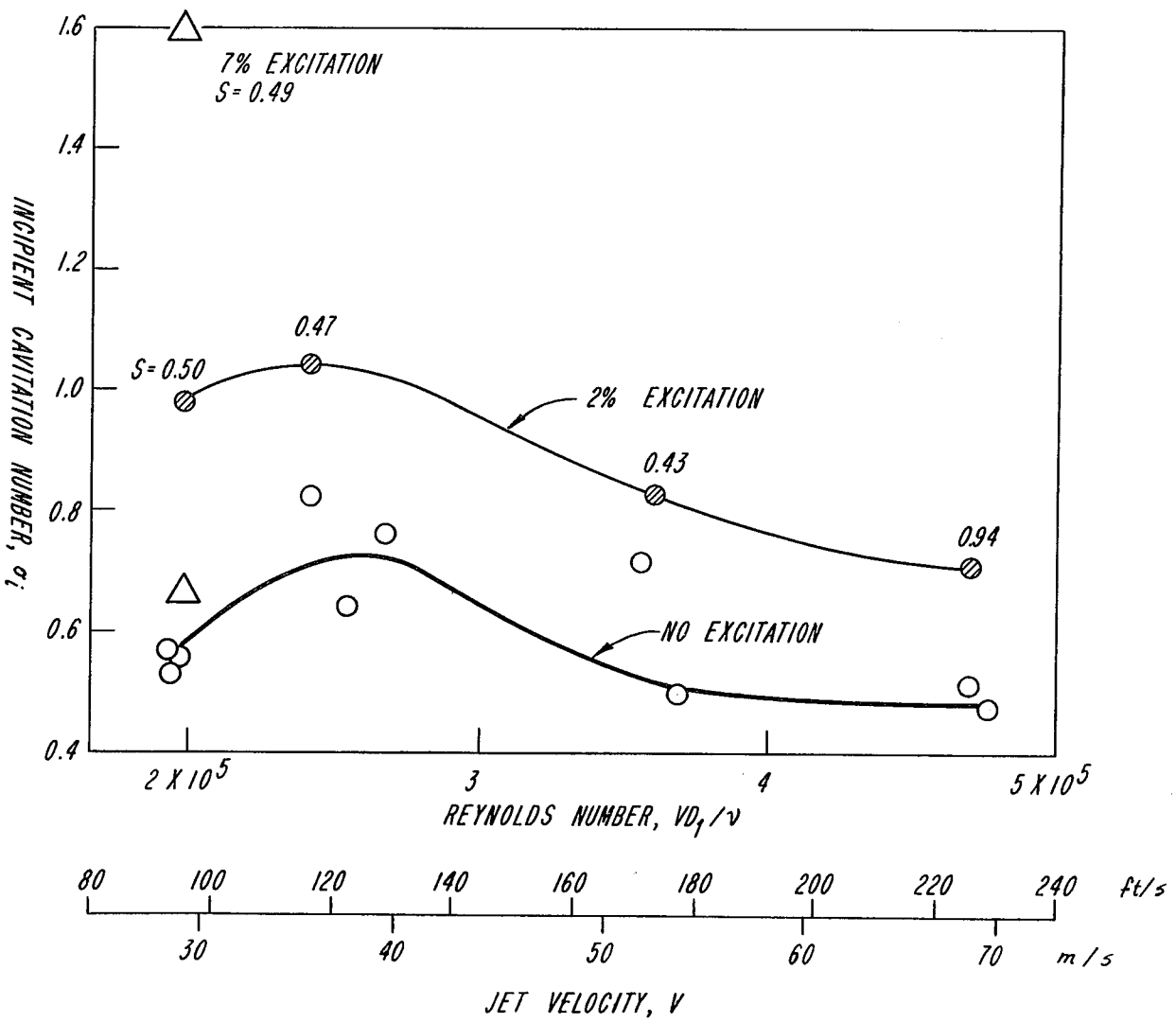
FIG. 15 is a graph showing the observed values of incipient cavitation number for various jet velocities and Reynolds numbers, with and without excitation of the jet.

FIG. 15 shows the observed values of incipient cavitation number $\sigma_i$ using the test rig shown in FIG. 12 for various jet velocities or Reynolds numbers for the case of no excitation, 2% excitation, and 7% excitation. (Percent excitation means excitation amplitude$\div(P_o-P_a)\times 100$). The data show that the incipient cavitation number was nearly doubled for 2% excitation and more than tripled for 7% excitation.

It is significant to note in FIGS. (14) and (15) that the creation of discrete vortices was accomplished at Reynolds numbers ($Vd/\nu$, where $\nu$ is the kinematic viscosity) of nearly $5\times 10^5$. This result is contrary to the teachings of U.S. Pat. No. 3,398,758 and is not suggested by any other prior art workers.

ADDITIONAL EXPERIMENTS USING SELF EXCITED NOZZLES

Several versions of the self-excited pulser nozzles described above were built and tested and compared with conventional cavitating jet nozzles. The nozzle contour of each of the conventional cavitating jet nozzles tested was substantially as described in U.S. patent application Ser. No. 931,244.

Figure 16:
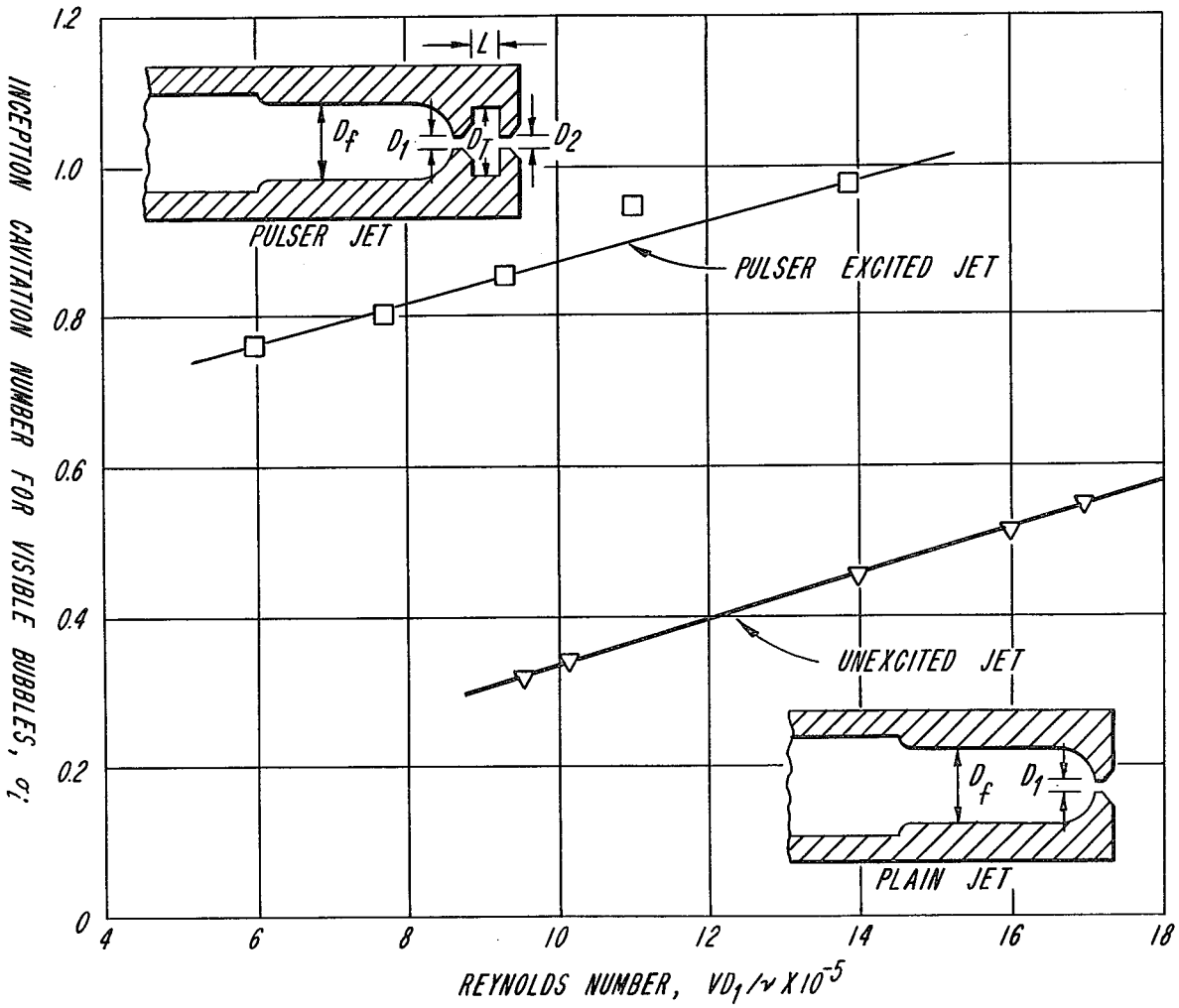
FIG. 16 shows the difference in incipient cavitation number observed between a pulser excited and an unexcited cavitating jet, and illustrates the configuraion of the two nozzles tested.

FIG. 16 shows the difference in incipient cavitation number between a conventional cavitating jet and a pulser nozzle of the same diameter for a range of Reynolds numbers. Details of construction of each nozzle are shown in the figure. The pulser nozzle was observed to have an incipient cavitation index twice that of the conventional cavitating jet nozzle. For the pulser nozzle, $D_1=6.2$ mm (0.244 in.), $D_2=5.6$ mm (0.220 in.), $D_r=22.4$ mm (0.88 in.), $D_f=25.4$ mm and L=10.6 mm (0.416 in.); and for the plain cavitating jet nozzle, $D_f=1.0$ in. (25.4 mm) and $D_1=6.2$ mm (0.244 in.).

Figure 17:
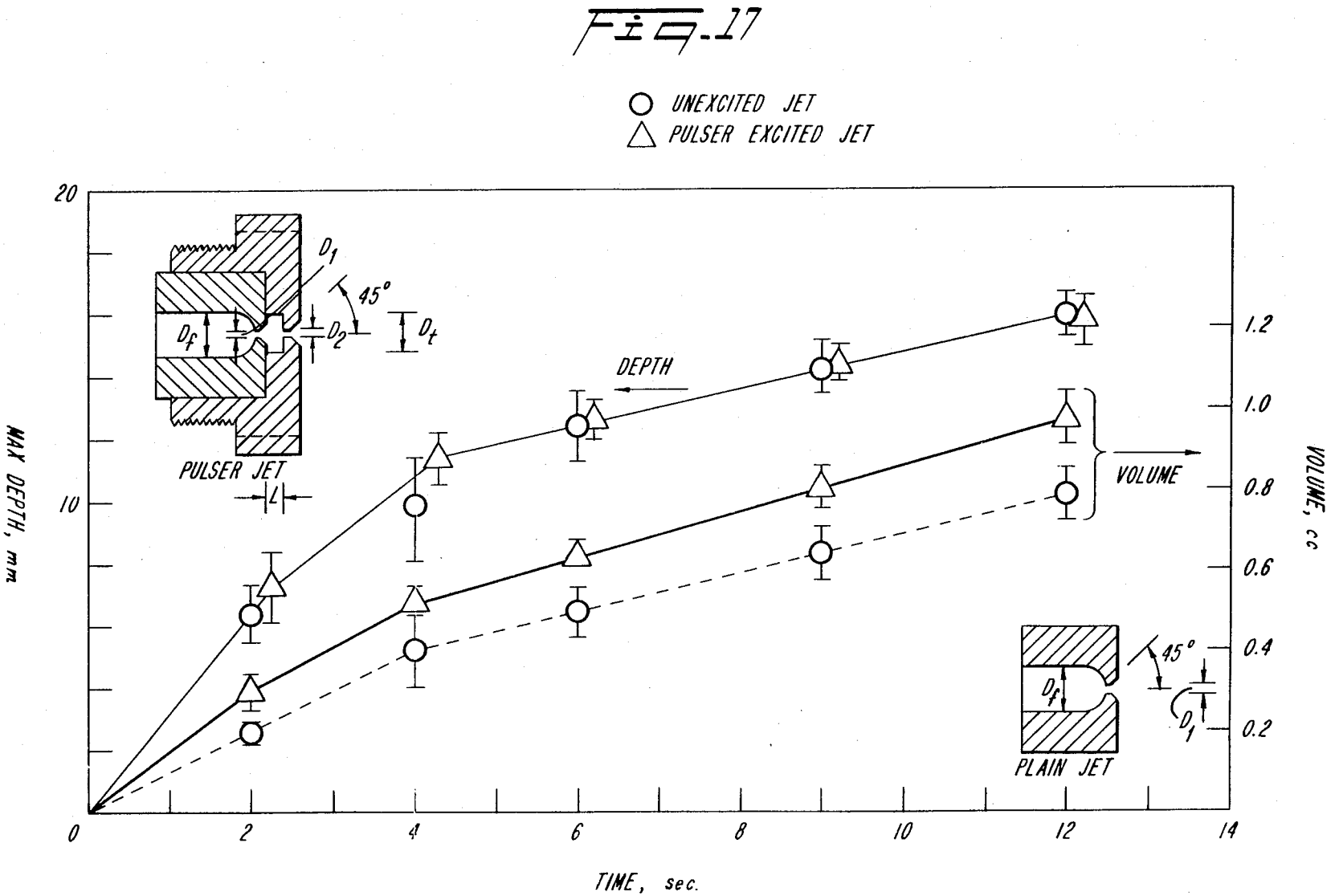
FIG. 17 is a graph showing a comparison of depth and volume erosion histories observed with an unexcited jet and a pulser-excited jet, and illustrates the configuration of the two nozzles tested.

FIG. 17 compares the depth and volume of erosion of a Pulser nozzle and a conventional cavitating jet nozzle having the same 2.2 mm diameter when each was tested at a low cavitation number ($\sigma$=0.015) and with a jet velocity corresponding to a Mach number of approximately 0.08 and $D_T$=0.36 inch. The configuration of each nozzle are shown in the Figure. Although the depth of erosion was about the same for both nozzles, the volume of erosion was approximately 20% greater for the Pulser nozzle. The test material was Berea Sandstone and the material was located approximately 10 diameters from the nozzle exits.

Figure 18A:
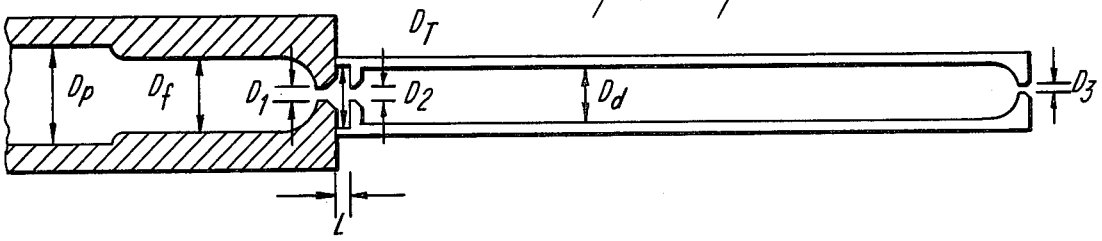
FIGS. 18*a* and 18*b* show the configuration of a Pulser-Fed nozzle which was constructed in accordance with the invention and a conventional cavitating jet nozzle which was constructed to have equivalent discharge characteristics for comparative testing purposes.
Figure 18B:
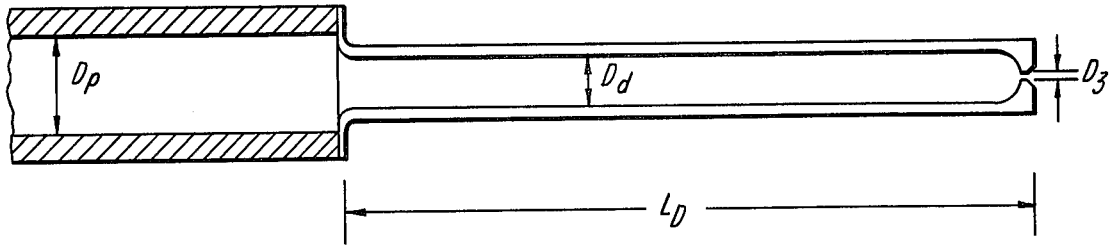

FIG. 18*a* shows the configuration of a Pulser-Fed nozzle which was constructed in accordance with the invention, and FIG. 18*b* shows a conventional cavitating jet nozzle which was constructed to have equivalent discharge characteristics for comparative testing purposes. In the Pulser-Fed nozzle of FIG. 18*a* $D_f$=1.0 inch, $D_1$=$D_2$=0.25 inch, $D_T$=0.75 inch, $D_3$=0.196 inch, $D_d$=0.68 inch, $L_D$=8.75 inches L=0.20 inch, while in the plain cavitating jet nozzle of FIG. 18*b*, $D_P$=1.38 inches, $D_d$=0.68 inch, $D_3$=0.196 inch and $L_D$=8.75 inches. In experiments using these two nozzles at a cavitation number of 0.25 and a velocity of 400 fps, discrete vortices were formed by nozzle 18*a* and spread over the boundary as anticipated from the previous discussion. Such vortices were not produced by nozzle 18*b*.

Figure 19:
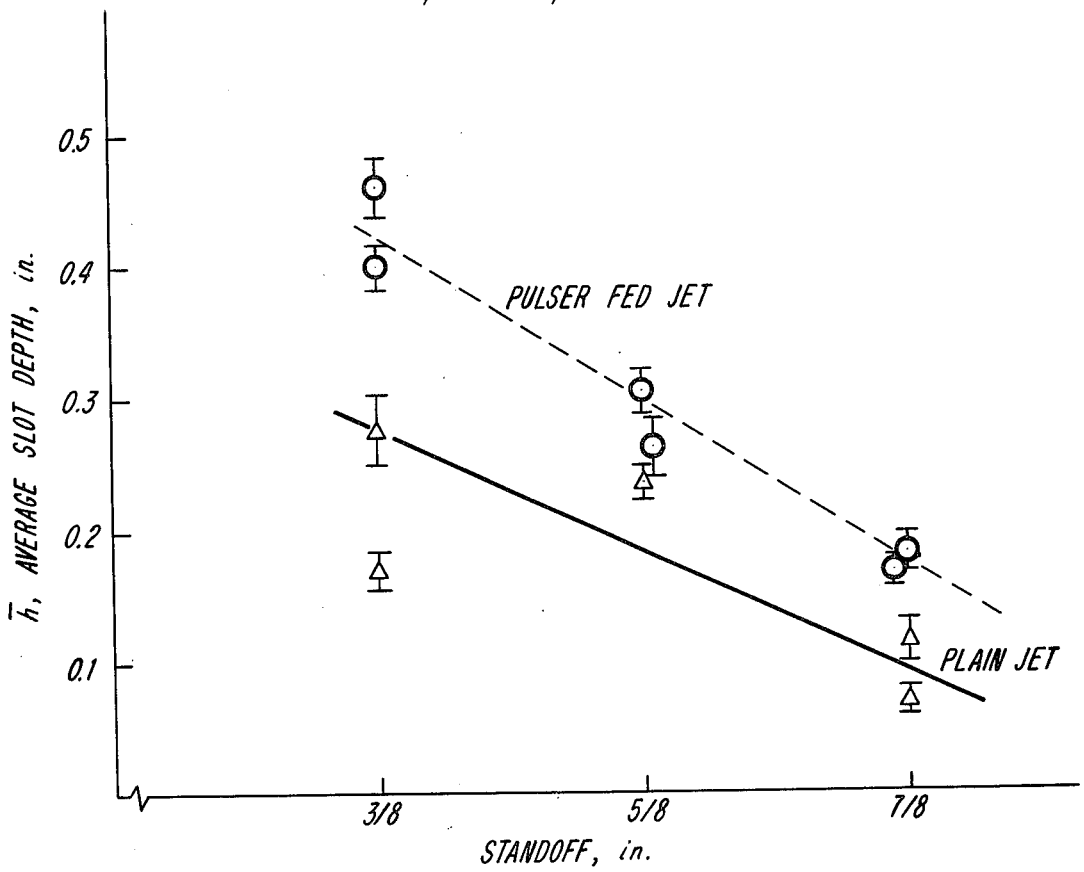
FIG. 19 is a graph showing a comparison of the depth of erosion observed for the two nozzles shown in FIG. 16.

FIG. 19 presents a comparison of the depth of erosion measured in Berea Sandstone for a range of stand-off distances for the Pulser-Fed nozzle shown in FIG. 18*a* and a plain jet nozzle of FIG. 18*b* having equivalent discharge (and exit diameter equal 0.196 inches). The data shown are for a cavitation number of 0.50 and a jet velocity of 365 fps. FIG. 19 shows that the depth of erosion is approximately 65% greater for the Pulser Fed nozzle 18*a*. It is important to recognize that FIG. 19 compares the two nozzles at the same jet velocity and not the same total pressure drop across each system. In these tests the pressure across the Pulser-Fed system was approximately 25% greater than across the other nozzle. Thus, practical Pulser-Fed nozzles should incorporate lower loss diffuser chambers such as those shown in FIGS. 9*b* and 9*c*.

Stationary jet drilling tests were made in Sierra White granite specimens. These tests compared the drilling rates of three different sizes of conventional (plain) cavitating jet nozzles (D=0.1 inch, 0.204 inch and 0.28 inch) and a Basic Pulser nozzle with $D_1$=$D_2$ =0.204 inch. The plain cavitating jet nozzles, with diameter 0.1 inch and 0.281 inch were tested simultaneously (side by side with fluid supplied from the same plenum) and the 0.204 inch diameter plain cavitating jet and Basic Pulser were tested simultaneously in the same manner in a second test. The test variables in both tests included a nozzle pressure drop range of 1000 to 6000 psi and a cavitation number range of 0.1 to 2. The nozzle stand-off distance for all tests was 0.563 inch.

The results obtained may be summarized as follows for a nozzle pressure drop of 5000 psi:

(1) the 0.1 inch diameter plain cavitating jet produced negligible penetration for all conditions;

(2) the 0.283 inch diameter plain cavitating jet produced a penetration rate which varied from 0.1 mm/sec to 0.03 mm/sec for cavitation numbers varying from 0.15 to 1.0; and (3) both the 0.204 inch diameter plain cavitating jet and the 0.204 inch pulser produced penetration rates of approximately 0.3 mm/sec for cavitation numbers varying from 0.15 to 1.0.

Since my previous experience has shown that the penetration rate for plain cavitating jet nozzles increases with nozzle size, the 0.204 inch diameter plain cavitating jet nozzle would have been expected to produce a penetration rate less than that obtained with the 0.283 inch diameter plain cavitating jet. The very high penetration rate obtained with the 0.204 inch diameter plain cavitating jet when tested alongside the 0.204 inch diameter Basic Pulser nozzle indicates that it was excited by the adjacent pulser excitation to produce a penetration rate similar to the Basic Pulser. The test results clearly demonstrate the improved performance of jets excited at or near the preferred Stouhal number. Furthermore, the tests showed that the jet from a non-pulser (i.e., conventional cavitating jet) nozzle can be excited by an adjacent pulser nozzle.

I have thus found that a pulser nozzle supplied from the same plenum as non-pulser nozzles and discharging into the same chamber as non-pulser nozzles will excite the non-pulser nozzle jets and cause them to operate as excited jets, as described above. This phenomenon may be applied in any manifolded jet system to improve the performance of the system. For example, FIG. 20 illustrates the use of a central pulser nozzle to excite the plain cavitating jet nozzles located in the extended arms of a two or three cone roller bit used in deep hole drilling.

FIG. 20 shows the extended arms and jets used in two and three cone roller bits for supplying drilling fluid to the hole bottom during drilling. Drilling fluid from the drill pipe plenum 70 is supplied to the conventional cavitating jet nozzles 71 located near the hole bottom 72 through extended arms 73 and also through a centrally located nozzle 74. In this embodiment of the invention the central nozzle 74 is a pulser nozzle designed to produce a frequency of pulsation that results in a Strouhal number based on the diameter and velocity of plain cavitating jet nozzles 71 in the range 0.2 to 1.2 and preferably in the range of from about 0.3 to about 0.8.

Acoustic waves propagated from the central pulser nozzle 74 excite nozzles 71 so as to create discrete vortices 75 and thus erode the hole bottom 72 at rates higher than if nozzle 74 were not a pulser nozzle oscillating at the preferred Strouhal number.

As pointed out above, in order to achieve self excited jets that are structured into discrete ring vortices, it is important that the jet forming nozzle be properly designed. Numerous experiments have been carried out along with theoretical analysis in regard to the design of nozzles to be used in self excited jet systems, and particularly for use in the Organ-Pipe Acoustic Oscillator described above.

Figure 21:
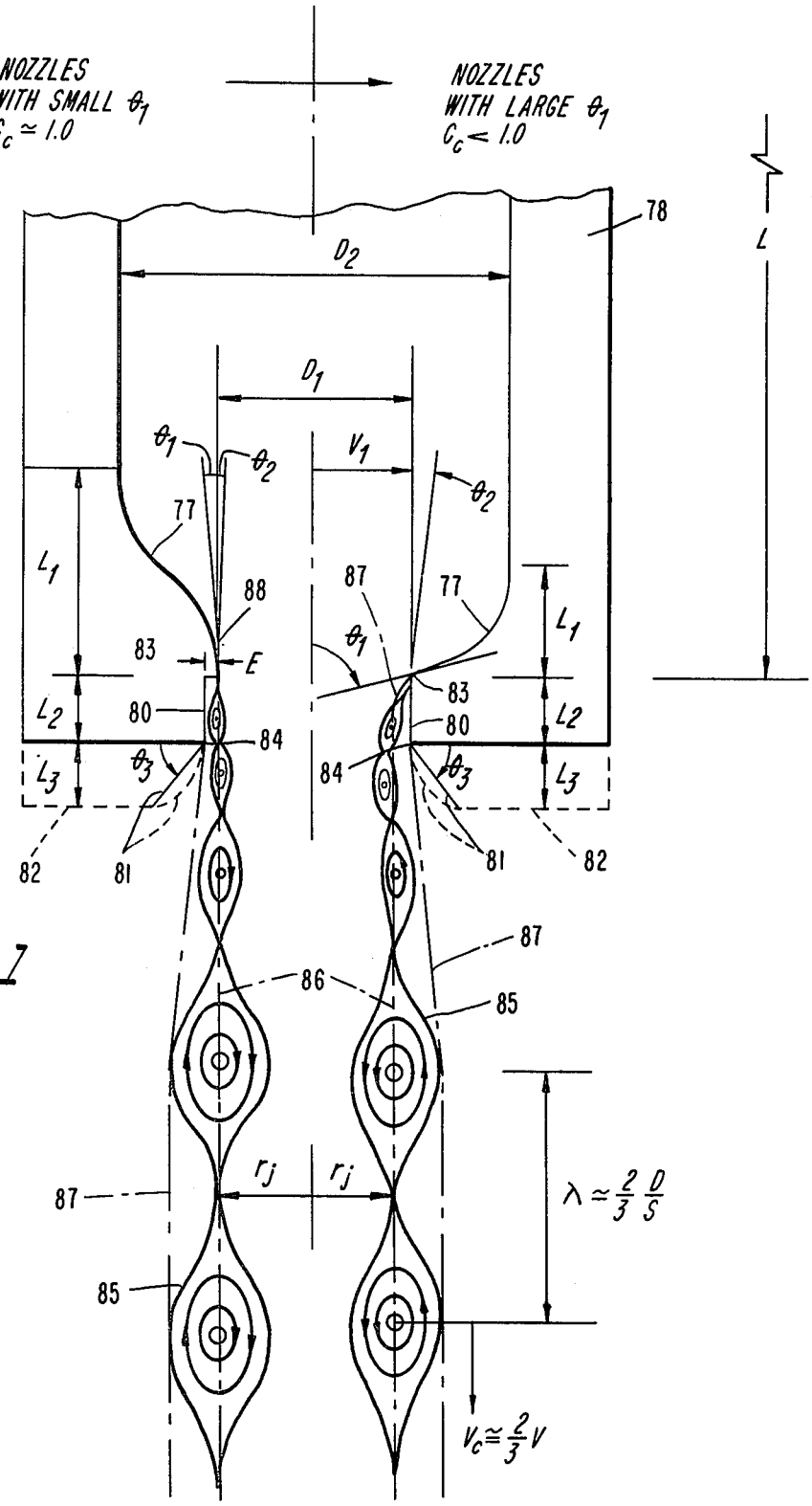
FIGS. 21 and 21*a* shows alternative configurations of a jet-forming nozzle suitable for use in self-excited systems according to the present invention.

FIG. 21 illustrates several different features and embodiments of the type of jet forming nozzle that is suitable for application to the self excited jet systems of the present invention, and preferably to the Organ-Pipe-Acoustic Oscillator.

In FIG. 21, two types of nozzles are illustrated. Shown on the right hand side of the centerline are a class of nozzles similar to those illustrated in the other Figures herein and in U.S. Pat. Nos. 3,538,704, 3,713,699, 3,801,632, and 4,262,757. This class of nozzles has a nozzle contour with $L_1/D_1 \leqq 1$ and an exit angle, $\theta_1$, greater than 30° and less than 90°. Such nozzle contours are preferred so as to minimize the vortex core sizes that are formed when the jet structures into discrete ring vortices. Small core sizes increase the incipient cavitation number, as shown in Equation 7. Jets with higher incipient cavitation numbers are more erosive. While nozzles having relatively high values of $\theta_1$ are generally preferred, there are applications where cavitation may not be of interest, or where the nozzles must have small values of $\theta_1$ such as, for example, those shown on the left hand side of the centerline in FIG. 21. If the other features of the nozzle are designed properly, as will be discussed in detail below, such small $\theta_1$ nozzles (and nozzles with $L_1/D_1>1$) can also be caused to self excite.

As illustrated in FIG. 21, flow approaches the jet forming nozzle 78 through the organ-pipe supply pipe 79, having diameter $D_2$, and is contracted to diameter $D_1$ by the nozzle contour 77, having length $L_1$ and an exit angle $\theta_1$, followed by a straight section 80 of length $L_2$ which makes an angle with the jet center line of $\theta_2$, followed by another optional straight or curved section 81 of length $L_3$ at angle $\theta_3$, followed by the end face of the nozzle 82 which would normally be perpendicular to the jet centerline. I have found that the most important features of the nozzle design, from the standpoint of the successful practice of the invention, are the presence of the sharp edge at location 83, producing an abrupt change, or discontinuity, in slope, and the physical location of the intersection of the straight sections 80 and 81 at a point 84 where the nozzle radius is $r_1-L_2 \tan \theta_2$.

My experiments reveal that if the operating conditions are such that cavitation occurs ($\sigma/\sigma_i<1$), self excitation will occur if the external contour 81 is either straight (conical) or curved as shown by the dashed curve. However, self excitation can be caused for both cavitating ($\sigma/\sigma_i<1$) and non-cavitating ($\sigma/\sigma_i>1$) conditions when the external contour is curved so that there is no change in slope at the intersection 84 of the throat section 80 with the external contour 81. The exact length of the throat 80 and curvature of the section 81 determine the critical Strouhal number of the nozzle as described below, that is, the Strouhal number at which the jet structures into well defined ring vortices.

The principal of operation of the jet forming nozzle in combination with the organ-pipe supply pipe (or other hydro-acoustic oscillator, as the case may be) is as follows:

If the organ-pipe senses a periodic variation in velocity (or pressure) at the nozzle exit 83 of diameter $D_1$ whose frequency corresponds to one of its natural frequency modes (which frequency has been specifically selected to correspond to the critical Strouhal number required for jet structuring or conversely, the nozzle has been configured to yield a critical Strouhal number which corresponds to one of the organ-pipe modes) the exit velocity fluctuations will be amplified. This amplified velocity increases the structuring of the jet into discrete ring vortices which increase the exit velocity (or pressure) fluctuations (if the nozzle is properly designed) and the system becomes self excited. The solid lines 85 in the jet flow in FIG. 21 illustrate the development of the ring vortex structure and the dashed lines 86 show the free streamline of the jet (with no mixing). The broken line 87 shows the outer envelope of the developing vortex flow.

The important feature of the nozzle which permits and enhances feedback of velocity oscillations in the jet to the organ-pipe supply is the sharp edge at 83 and the following sections 80 and 81. If the sections 80 and 81 lie sufficiently near to, but sufficiently above, the unmixed free streamline 86 so as not to interfere with the development of the ring vortices 85 which grow through the roll-up and pairing of vortices formed from the issuing shear layer, a pressure oscillation will be created along sections 80 and 81, and consequently at the nozzle exit plane, which is periodic and feeds the self excitation. The feedback gain (or amplification) increases with the increase in the distance between the sharp edge at 83 and the point of osculation of the nozzle external contour 80 and 81, with the outer envelope 87 until reaching a maximum value. This length also determines the critical Strouhal number of the nozzle as explained below.

Figure 21A:
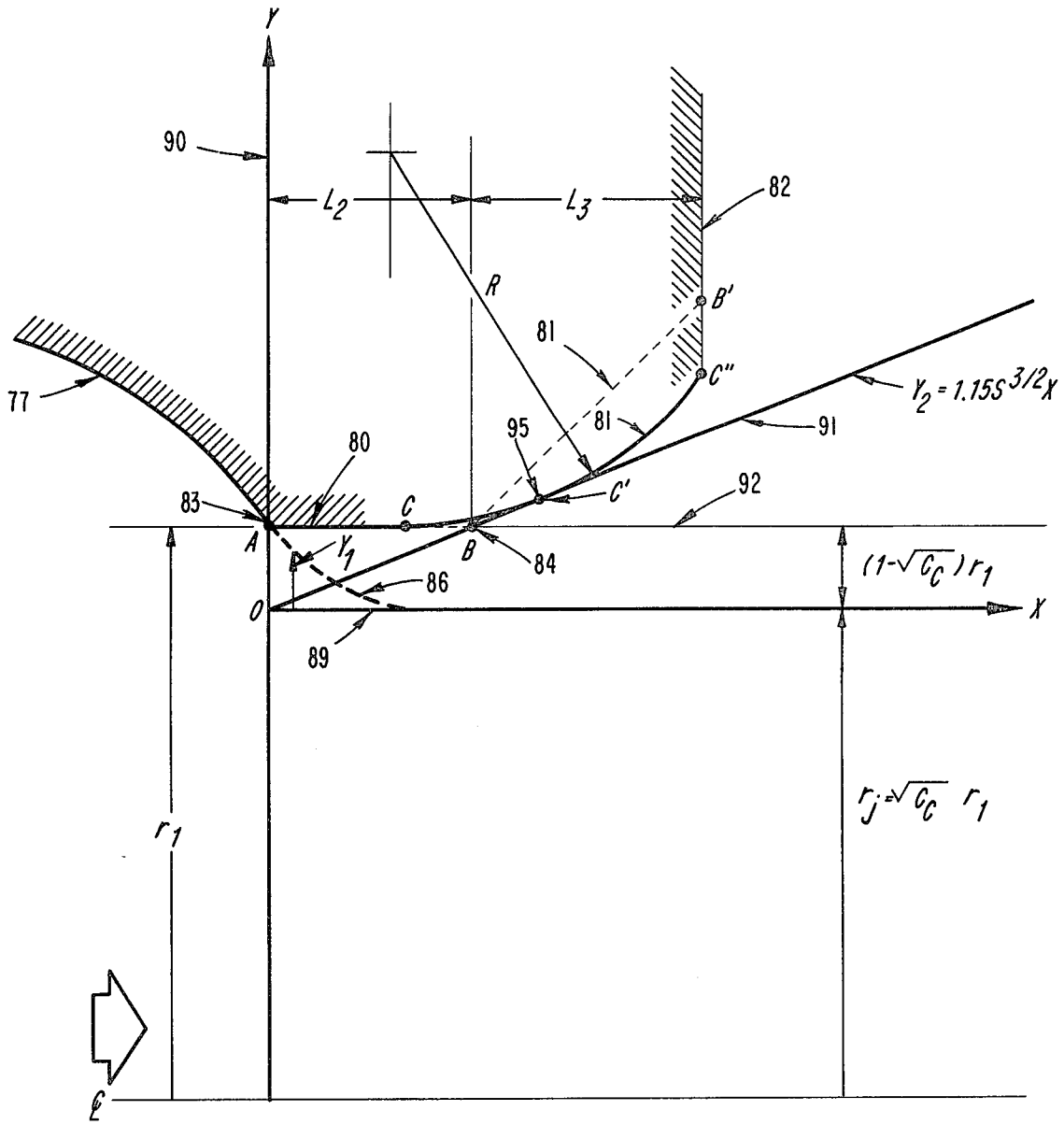

FIG. 21*a* shows how the external nozzle contour may be designed so as to cause self excitation at a desired critical Strouhal number. It is assumed that the nozzle is supplied by an organ-pipe system (or other acoustic system) whose natural frequency equals the frequency corresponding to the critical Strouhal number for which the nozzle is designed. The method of design establishes the coordinate axes (X,89), (Y,90) with the origin, O, located in the orifice plane passing through the sharp edge 83 and at a radius from the nozzle centerline equal to the steady contracted jet radius, $r_j$. The ratio $r_j/r_l$ is commonly referred to as the jet contraction ratio of the nozzle. The value of $r_j/r_l$ may be found in standard reference such as "Engineering Hydraulics" by Hunter Rouse, John Wiley and Sons, Inc., 1950, page 34. In this reference the area contraction ratio, $C_c=(r_j/r_l)^2$ is tabulated for various values of $D_1/D_2$ and for several values of exit angle $\theta_1$. Values of $C_c$ for values of $\theta_1$ not tabulated may be obtained by interpolation.

Experiments which I conducted in water show that the ordinates of the envelope of the developing vortex structure may be approximately determined by adding the ordinates of the steady jet contour ($Y_1$,86) and the ordinate given by the line ($Y_2$,91) in FIG. 21*a*. The ordinate $Y_2$ has been experimentally determined by me for water to be:

$$Y_2=1.15S^{3/2}X \qquad (42)$$

Equation 42 is denoted as the line 91 in FIG. 21*a*.

Since the steady contraction ordinate $Y_1$ is generally negligible at the osculatory point 95 (where the nozzle contour touches the developing vortex envelope 86) for most nozzles of interest; $Y_1$ may be neglected. It is estimated that the neglect of $Y_1$ also provides a slight gap between the envelope and the assumed osculatory point 95 on the nozzle.

For cavitating conditions ($\sigma/\sigma_i<1$) the nozzle will self excite at the Strouhal number, S, if the straight throat 80 is terminated at B (84), the intersection of throat 80 and the line 91. The nozzle may be terminated at this location 84, as shown in FIG. 21 (solid lines) with $L_3=0$, or for $L_3>0$ a straight or conical section BB', denoted as 81, may be added before terminating the nozzle with the face 82. The slope of this additional conical section (BB') must be selected so as to be greater than the slope of the line 91 by several degrees. My experiments indicate that the addition of a conical section reduces the actual critical Strouhal number by approximately 10 percent when $L_3=0.5L_2$. Successful nozzles have been tested for $0<L_3<L_2$; however, it is preferred that $L_3\leqq 0.5L_2$.

Although nozzles designed with the sections 80 and 81 straight (conical) do self excite under cavitating conditions, such nozzles do not usually self excite under noncavitating conditions. As pointed out below, structured jets should improve bottom hole cleaning in connection with oil and gas well drilling and are thus desired for all operating conditions—cavitating and noncavitating. It has been determined experimentally that nozzles can be designed which will self excite under all operating conditions if the throat section 80 and the external contour 81 comprise a smooth, continuous surface which osculates with the conical surface defined by the line $Y_2$ (91) in FIG. 21*a* as shown, and as will be described in greater detail below. Such a curve should not only be smooth but should have increasing slope. Embodiments using a circular arc with a radius R such that the distance BC' is approximately 0.4 times the distance AB (as shown in FIG. 21*a*) have been found to give satisfactory results. The center for this arc is located so that the curve is tangent to both lines 80 and 91. Satisfactory results should also obtain for parabolic or elliptical or other curves which approximate the circular arc. The termination surface 82 is preferably located about (0.1 to 0.2)$D_1$ downstream of the line of osculation 95.

The method of nozzle design presented in the foregoing discussion is based on numerous experiments conducted in air and water. The specific envelope line (91 in FIG. 21*a*) is based on results obtained in water at Reynolds numbers of approximately $7\times10^5$. For other fluids (such as drilling mud) with fluid properties different from water (or water at substantially different Reynolds numbers), the jet envelope line (91 in FIG. 21*a*) may be determined experimentally by testing nozzles with $L_3=0$ and with several different throat lengths $L_2$, and determining the constants A and n in the general envelope equation:

$$Y_2=AS^nX \tag{43}$$

Such tests to determine A and n should be done under cavitating conditions.

The experiments involve supplying a nozzle of given diameter with an organ-pipe of given length, and thus a natural frequency, and varying the Mach number so as to obtain peak oscillation. The Strouhal number for the peak oscillation is recorded for each value of $L_2$. S versus $L_2$ may then be plotted on log paper so as to determine A and n (with $Y_2$ at $X=L_2$ known to be $(1-\sqrt{C_c})r_1$). Once A and n are determined, nozzles with smooth curvatures may be designed for operation in both cavitating and noncavitating conditions.

My experiments show that nozzles designed without sharp steps in the nozzle contour downstream of the step at 83 have incipient cavitation numbers as much as eight times as great as conventional (unstructured) jets which issue, for example, from the nozzles currently used in deep hole drill bits. Furthermore, nozzles without discontinuities in slope downstream of the discontinuity at 83 have higher incipient cavitation numbers than those which do have a second discontinuity (B in FIG. 21*a*). Therefore the preferred nozzle shape in accordance with the invention is one with a smooth curvature downstream of 83, as shown by the solid line ACC'C''.

For embodiments of the invention where the angle $\theta_1$ (FIG. 21) is less than 30°, the value $1-\sqrt{C_c}$ becomes less than 0.08. My experience shows that strong self excitation requires a distance between the contracted jet and Y=0A (line 92) in FIG. 21*a* of at least $0.08r_1$. For such nozzles with values of $\theta_1<30°$, a step should be located at 83 in FIG. 21 of depth E such that the total distance $$0.2r_1 \leqq (1+\sqrt{C_c})r_1 + E \geqq .08r_1 \tag{44}$$

The design procedure for the remaining nozzle external contour is the same as discussed above for large $\theta_1$ nozzles, except that line 92 (FIG. 21*a*), which is parallel to the nozzle center line and passes through A, is offset by the amount E.

If the nozzle design with orifice diameter $D_1$ is to self excite at a specified Mach number when installed in an organ-pipe system whose length L is fixed, then equation 40 is used to determine the value of N/S (assuming equation 40b is applicable) required to obtain self excitation. My experiments show that the values of S must be between 0.3 and 0.8 for strong excitation. Since the circulation of each ring vortex increases with a decrease in S, N should be selected to give the lowest value of S that is not less than 0.3. When the organ-pipe length is free to be selected, best results will be obtained by selecting N=1 and S=0.3 to 0.4.

The measured width of Mach number variation about the design Mach number for strong oscillations in an organ pipe system using nozzles designed according to the present invention is approximately ±15%. This width corresponds to a variation about the design nozzle pressure drop of approximately ±30%. The fact that the response width is not narrow enables such nozzles to operate without great attention to fine tuning of the Mach number or the pressure drop across the nozzle.

The above-recited description and analysis explain the important factors to be taken into account when designing a nozzle for a self excited jet which will structure into discrete ring vortices in accordance with the present invention. While the use of nozzles constructed in accordance with the principles described herein is essential to the proper functioning of the Organ-Pipe Acoustic Oscillator embodiments of the invention, it is not essential that they be used in conjunction with the other embodiments, such as, for example, the Pulser and Pulser-Fed systems. However, use of such nozzles will improve the performance of such systems.

As discussed above, one of the reasons a structured jet enhances erosion is that, as the ring vortices approach the boundary material, they expand and induce very high velocities not only within the vortex core, but also directly on the boundary material to be eroded. The low pressure created on the boundary material is another location for cavitation to occur and thus enhance the erosion of the boundary by the action of the jet. In addition to this cavitation effect, there is another important feature of structured jets in accordance with the present invention which does not require that the minimum pressure in the flow field reach values below vapor pressure and cavitate.

U.S. Pat. No. 3,405,770 describes a phenomenon known as "chip hold down" which occurs at the bottom of a deep hole being drilled for the exploration or production of oil or gas. Briefly, an overbalance of pressure is usually maintained at the hole bottom; that is, the presence in the hole is maintained 100 psi to several thousand psi greater than the sea water hydrostatic pressure at the depth of the hole bottom. This overbalance in pressure causes the chips formed during drilling (as well as mud particles) to be held down on the formation being drilled, thus causing a reduction in the rate of penetration that could be obtained in the absence of the overbalance.

I have found that a jet is structured into vortex rings in accordance with the invention will tend to alleviate the chip hold down problem. Although high velocity jets are currently used in the drill bits used for petroleum deep hole drilling, these conventional jets provide very weak force reversals on bottom hole chips. However, if the jet is structured in accordance with the invention, strong force reversals are created on the hole bottom which will relieve the chip hold down and thus increase the rate of penetration. Such structured jets may be achieved passively by any of the methods described herein.

Figure 22:
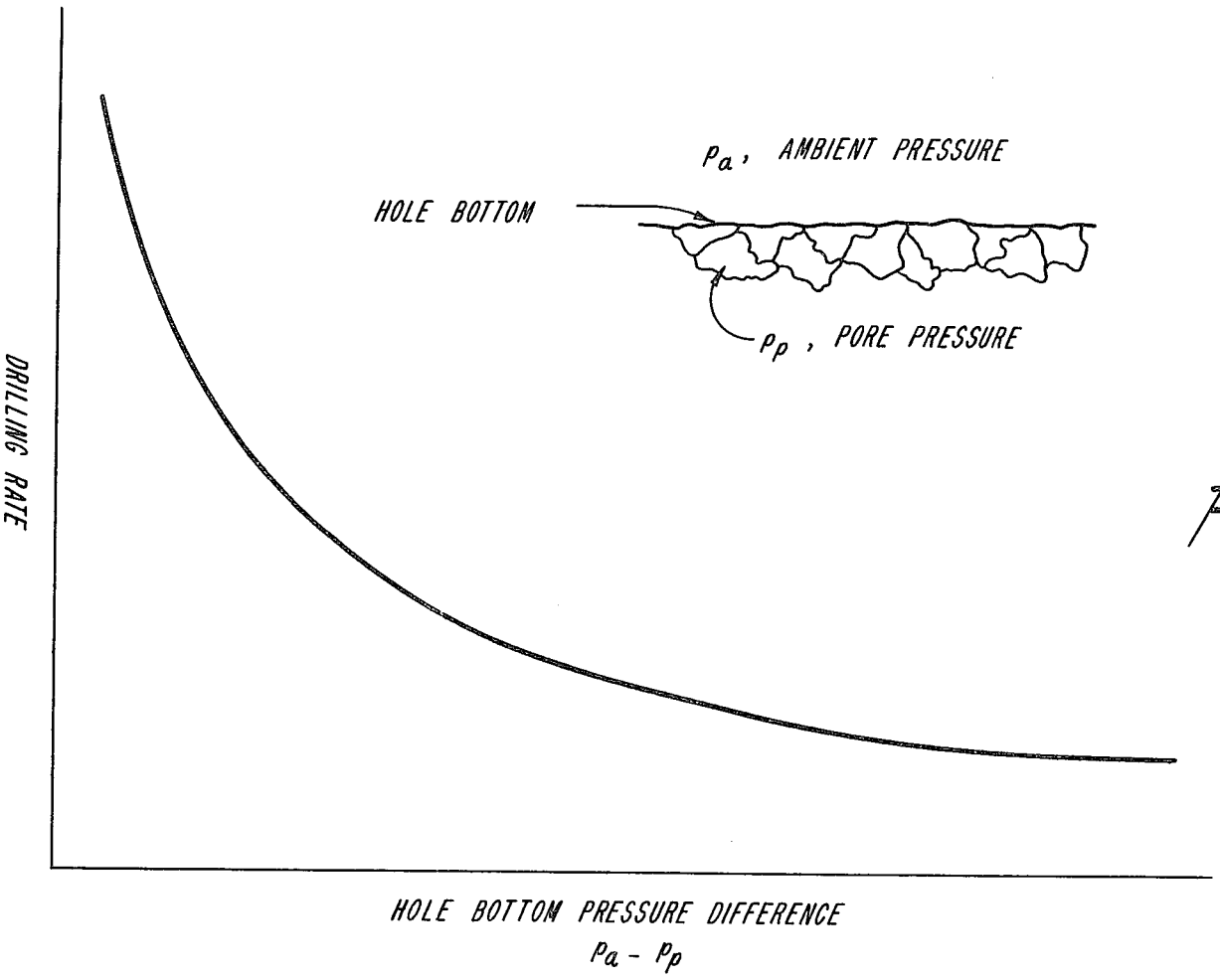
FIG. 22 is a graph showing a decrease in drilling rate with increases in the pressure difference at the hole bottom in deep hole drilling (e.g., for oil and gas wells)

FIG. 22 illustrates the effect of the hole bottom pressure difference on the drilling rate of rotary mechanical bits such as are used in oil well drilling. Liquid jets which are used in conventional bits to remove the chips formed by the mechanical action of the bits are not adequate to dislodge the chips rapidly enough as they are held against the hole bottom by the pressure difference. Thus the drilling rate decreases substantially as the magnitude of the pressure difference increases. This effect is well known in the petroleum industry.

U.S. Pat. No. 3,405,770 discloses very complex means to oscillate the entire ambient pressure about the mean level so that the minimums of the oscillation reduce the instantaneous pressure difference to zero or negative values. The schemes proposed function at relatively low frequencies, 100 Hz.

Figure 23A:
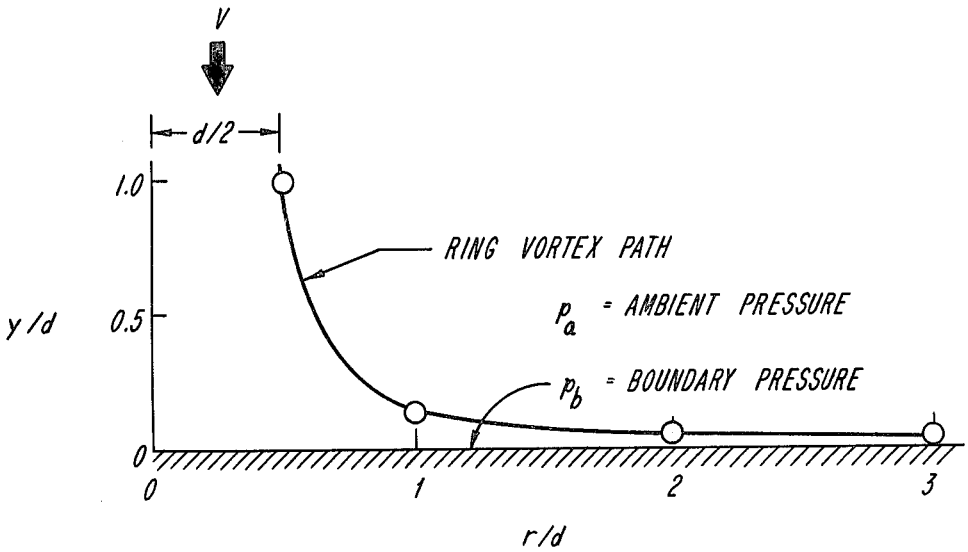
FIG. 23*a* is a schematic diagram showing the path of discrete ring vortices as they approach a boundary in accordance with the invention.

As discussed above, when a self excited, structured jet (jet having periodic discrete ring vortices) is impinged against a surface, the rings spread radially over the surface and induce very low pressures on the boundary beneath them as they pass over the surface. Equation 15 is an approximation for the value of the pressure induced on the surface. Further analysis using two dimensional line vortices to represent the rings in the region where r/d is greater than 1 is set forth below to establish approximately the complete instantaneous pressure distribution on the hole bottom. The analysis neglects viscosity. The results are shown diagrammatically in FIG. 23*a*. One half of the jet (symmetric about the centerline) is shown impinging against a boundary. The circled points are the assumed location of a vortex as it passes over the surface. The calculated values of $(P_b-P_a)/\Delta P$ are plotted versus radial location (r/d) in FIG. 23*b*. The cross hatched rectangles represent approximations to the calculated values; that is, the width (W) of a constant amplitude pulse is estimated to give the actual area under each pulse. Although the distance $\lambda$ between succeeding vortices increases with radial distance (that is, the vortex connection velocity increases with radial distance), the time that the pressure pulse acts is approximated in the region shown as $t_3=W/\lambda f$, where $\lambda$ is assumed to be constant and equal to d. In the region shown this simplification will not be in error more than by about a factor of 2.

Figure 24:
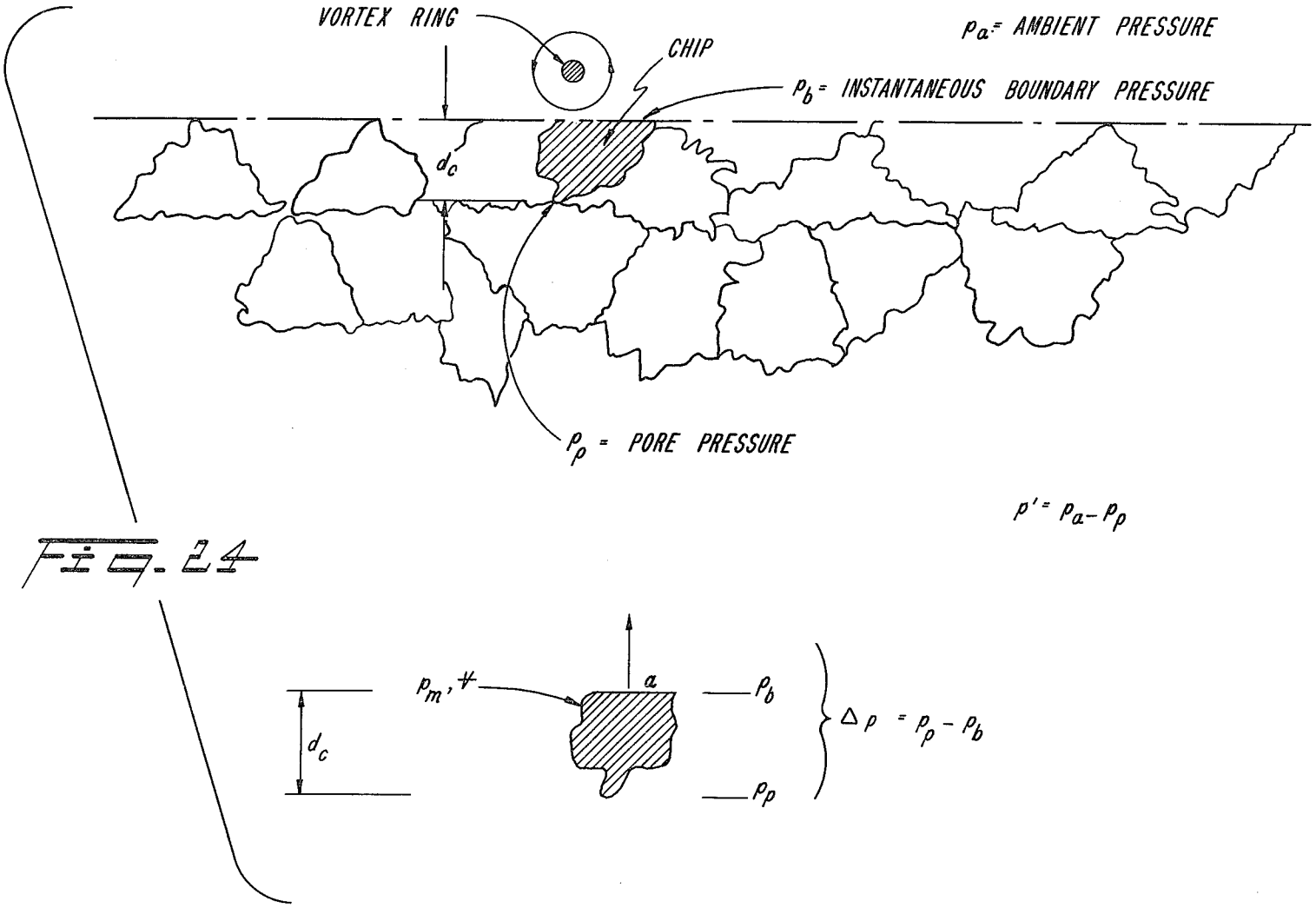
FIG. 24 is a schematic diagram showing the forces acting upon a chip formed at the bottom of a drilled deep hole, wherein the chip is exposed to the instantaneous pressures induced by a passing ring vortex in accordance with the invention.

In FIG. 24 a chip of characteristic dimension $d_c$ is shown being acted on by the instantaneous boundary pressure $P_b$ as a vortex passes. Also shown in this Figure are the ambient pressure $P_a$ and the pore pressure, $P_p$. The chip is taken to have density $\rho_m$ and virtual mass coefficient $C_m$. The volume of the chip is denoted as V. Neglecting the hydrodynamic drag on the chip, the vertical acceleration, a, of the chip will be $$a = \frac{\Delta Pc}{C_m \rho_m d_c}, \text{ where } \Delta Pc = K\Delta P - P' \quad (45)$$

The time, t, required to lift the chip one diameter will be $$t = \sqrt{\frac{2C_m\rho_m}{\Delta Pc}} \cdot d_c \quad (46)$$

Where $t=t_e=W/d_f$, then $$\frac{W}{d_f} = \sqrt{\frac{2C_m\rho_m}{\Delta Pc}} \cdot d_c \quad (47)$$

Since $\Delta P=\frac{1}{2}\rho V^2$, and $\Delta P_c=K\Delta P-P'$, Equation 47 may be written as $$\frac{V}{fd_c} \cong 2\frac{d}{W}\left(\frac{C_m\frac{\rho_m}{\rho}}{K-\frac{P'}{\Delta P}}\right)^{\frac{1}{2}} \quad (48)$$

or $$\frac{1}{S} \simeq \frac{4\frac{d}{W}}{\left(K-\frac{P'}{\Delta P}\right)^{\frac{1}{2}}} \cdot \frac{d_c}{d} \quad (49)$$

Taking S as approximately 0.5 for an excited structured jet, Equation 49 becomes, $$\frac{d_c}{d} \simeq \frac{\left(K-\frac{P'}{\Delta P}\right)^{\frac{1}{2}}}{2} \cdot \frac{W}{d} \quad (50)$$

Figure 23B:
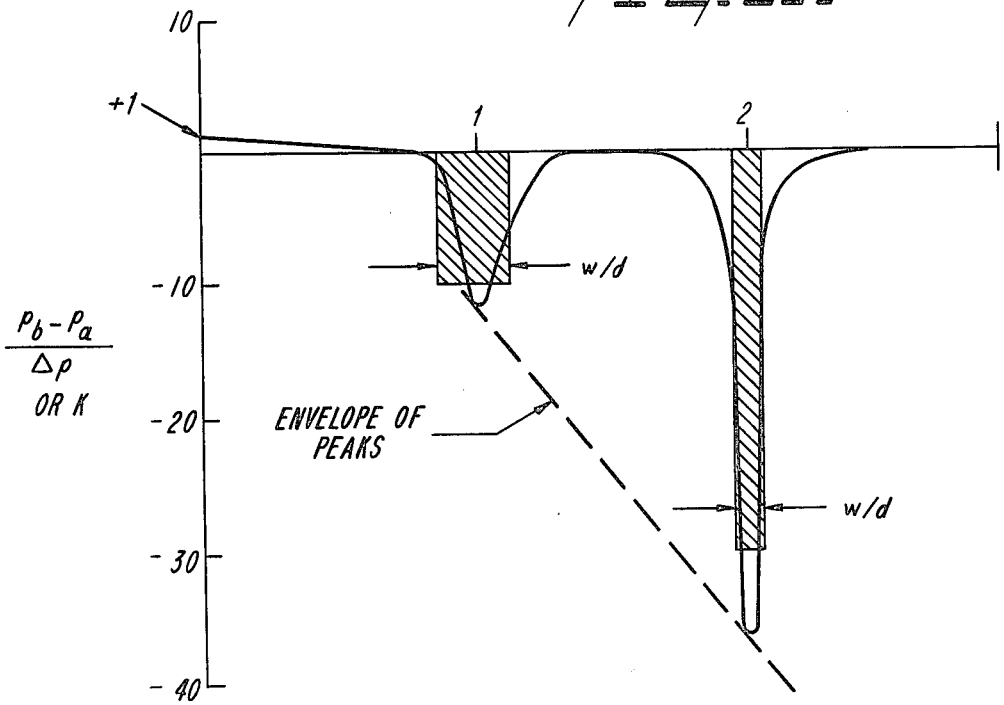
FIG. 23*b* is a graph showing the instantaneous value of the coefficient $K=(p_b-p_a)/\Delta p$ at various radial distances as a ring vortex spreads over a boundary in accordance with the invention.

Referring to FIG. 23*b*, where K is approximately 10 and $W/d \simeq 0.15$, and taking a practical operating value of $P'/\Delta P=1$, Equation 50 indicates that a chip size whose characteristic dimension $d_c$ is approximately 0.23 times the nozzle exit diameter will be lifted one chip length. This result is surprisingly large and is believed to indicate a heretofore unexpected benefit to be gained in deep hole drilling if the jets used in the conventional bits for cleaning the hole bottom are structured into discrete vortices in accordance with the present invention.

It will be apparent to those skilled in the art that various modifications and variations can be made in the method and apparatus of the present invention without departing from the scope or spirit of the invention. As an example, U.S. Pat. No. 3,538,704 shows several devices such as blunt based cylinders and disks located in the center of the cavitating jet forming nozzle for the purpose of causing low pressure regions in the center of the jet and thus cavitation forming sites within this central region. This patent also shows vortex including vanes for producing a vortex in the central region of the jet and thus low pressure cavitation sites within the center of the jet. Any of the embodiments described herein for pulsing a cavitating jet may also include, in the jet forming nozzle, the addition of any of the central devices described in U.S. Pat. No. 3,352,704. Also, the methods and apparatus for artifically submerging jets described in U.S. Pat. Nos. 3,713,699 and 3,807,632 may be used to artificially submerge any of the nozzle embodiments described herein. Thus, it is intended that the present invention cover the modifications of this invention provided they come within the scope of the appended claims and their equivalents.

What is claimed is:

1. A method of eroding a solid surface with a high velocity liquid jet, comprising the steps of:

(a) forming a high velocity liquid jet;

(b) oscillating the velocity of the jet at a Strouhal number within the range of from about 0.2 to about 1.2; and (c) impinging the pulsed jet against the solid surface.

2. A method as claimed in claim 1, wherein the liquid jet is pulsed by mechanically oscillating the velocity of the jet.

3. A method as claimed in claim 1, wherein the liquid jet is pulsed by hydrodynamic and acoustic interactions.

4. A method as claimed in claim 3, wherein a portion of the energy of the high velocity liquid is utilized to pulse the liquid.

5. A method as claimed in claim 1, wherein the liquid jet is formed by directing a liquid through an orifice, and the jet is pulsed by oscillating the pressure of the liquid prior to directing it through the orifice.

6. A method as claimed in claim 5, wherein the pressure of the liquid is oscillated by directing the liquid through a hydroacoustic organ-pipe oscillator having a nozzle, said nozzle comprising said orifice.

7. A method as claimed in claim 6, wherein the velocity of the jet is oscillated at a Strouhal number within the range of from about 0.25 to 0.65.

8. A method as claimed in claim 1, wherein the liquid is directed through a first orifice and the jet is formed by directing the liquid through a second orifice, and wherein the jet is pulsed by oscillating the pressure of the liquid after it exits the first orifice through hydrodynamic and acoustic interactions.

9. A method as claimed in claim 8 wherein a Helmholtz chamber is formed between the first and second orifices wherein the pressure of the liquid is oscillated within the Helmholtz oscillator.

10. A method as claimed in claim 1, wherein the pulsed, high velocity liquid jet is surrounded by a gas and forms into discrete, spaced apart slugs, thereby producing an intermittent percussive effect.

11. A method as claimed in claim 10, wherein the liquid comprises water and the gas comprises air.

12. A method as claimed in claim 10, wherein the velocity of the jet is oscillated at a Strouhal number within the range of from about 0.66 to about 0.85.

13. A method as claimed in claim 10, wherein the distance between the solid surface and the orifice from which the jet exits is determined by the following equation:

$$X=(D/2S)\cdot(V/v')$$

where X is the distance, D is the orifice diameter, S is the Strouhal number, V is the mean jet velocity and v' is the oscillation amplitude about the mean velocity.

14. A method as claimed in claim 1, wherein at least a portion of the surface is fragmented into chips and wherein the pulsed liquid jet is surrounded by a liquid and forms into discrete, spaced apart vortices which spread over the surface, thereby enhancing removal of said chips.

15. A method as claimed in claim 1, wherein the pulsed high velocity liquid jet is surrounded by a liquid and forms into discrete, spaced apart vortices, and wherein vapor cavities of the liquid are formed in the vortices and the vortices spread over the solid surface at a distance from the orifice where said vapor cavities collapse, thereby producing cavitation erosion.

16. A method as claimed in claim 15, wherein the velocity of the pulsed liquid jet is at least about Mach 0.1.

17. A method as claimed in claim 16, wherein the velocity of the jet is oscillated at a Strouhal number within the range of from about 0.3 to about 0.45.

18. A method as claimed in claim 16, wherein the velocity of the jet is oscillated at a Strouhal number within the range of from about 0.6 to about 0.9.

19. A method as claimed in claim 15, wherein the distance between the solid surface and the orifice from which the jet exits is no greater than about 6 times the diameter of the jet for cavitation numbers greater than about 0.2.

20. A method as claimed in claim 1, wherein the pulsed, high velocity liquid jet forms into discrete, spaced apart vortices, and wherein vapor cavities of the liquid are formed in the vortices and the vortices spread over the solid surface at a distance from the orifice where said vapor cavities collapse, thereby producing cavitation erosion, the formation of vapor cavities being assisted by a center body located in the outlet of the jet-forming nozzle to form an annular orifice for the nozzle.

21. A method of eroding a submerged solid surface with a liquid jet, comprising the steps of:

(a) forming a liquid jet by passing a liquid through a hydro-acoustic oscillator having a submerged nozzle;

(b) oscillating the velocity of the jet at the resonant frequency of said oscillator, said frequency corresponding to a Strouhal number within the range of from about 0.2 to about 1.2;

(c) amplifying the jet velocity oscillations by providing the exit nozzle with a contour adapted to provide feedback of the velocity oscillations in the jet to the oscillator; and (d) impinging the pulsed jet against the submerged solid surface.

22. A method as claimed in claim 21, wherein the oscillator comprises an organ-pipe oscillator.

23. A method as claimed in claim 21, wherein the oscillator comprises a Helmholtz oscillator.

24. A method of eroding a submerged solid surface with a liquid jet, comprising the steps of:

(a) forming a liquid jet structured into discrete, spaced apart vortices by passing a liquid through a hydroacoustic organ-pipe oscillator chamber having a submerged exit nozzle, said exit nozzle having a first portion with a contraction contour followed by a substantially cylindrical portion having its upstream end adjacent to said first portion, the junction of said first portion and said cylindrical portion forming a sharp edge, said cylindrical portion extending for a length sufficient to place its downstream end adjacent to an imaginary surface defining the outer envelope of the developing ring vortex flow;

(b) oscillating the velocity of the jet at the resonant frequency of said chamber, said frequency corresponding to a Strouhal number within the range of from about 0.2 to about 1.2;

(c) amplifying the jet velocity oscillations by providing feedback of the velocity oscillations in the jet to the oscillator chamber; and (d) impinging the pulsed jet against the submerged solid surface.

25. A method as claimed in claim 24, wherein said frequency corresponds to a Strouhal number within the range of from about 0.3 to 0.8.

26. A method of oscillating the instantaneous boundary pressure at a submerged surface, comprising the steps of:

(a) forming a high velocity, submerged liquid jet;

(b) oscillating the velocity of the jet at a Strouhal number within the range of from about 0.2 to about 1.2, whereby the jet forms into discrete, spaced apart vortices;

(c) impinging the discrete vortices against the submerged surface, whereby the instantaneous boundary pressure is reduced during each discrete time interval that one of the vortices passes adjacent said surface.

27. A method of removing the chips created at a submerged surface by a mechanical rotating roller bit drill, comprising the steps of:

(a) contacting the submerged surface with said drill, whereby at least a portion of the surface is fragmented into chips;

(b) forming a high velocity, submerged liquid jet;

(c) oscillating the velocity of the jet at a Strouhal number within the range of from about 0.2 to about 1.2, whereby the jet forms into discrete, spaced apart vortices; and (d) impinging the discrete vortices against said portion of the surface.

28. A method as claimed in claims 26 or 27, wherein the jet velocity is oscillated by a mechanical oscillator.

29. A method as claimed in claim 26 or 27, wherein the jet velocity is oscillated by directing the liquid through a hydroacoustic oscillator.

30. A method as claimed in claims 26 or 27, wherein the jet velocity is oscillated by directing the liquid through a hydroacoustic organ-pipe oscillator.

31. A method as claimed in claims 26 or 27, wherein the jet velocity is oscillated by directing the liquid through a hydroacoustic Helmholtz oscillator.

* * * * *